US006916503B2

(12) United States Patent
Morikawa et al.

(10) Patent No.: US 6,916,503 B2
(45) Date of Patent: Jul. 12, 2005

(54) BASE MATERIAL TO BE COATED, COATING APPARATUS, COATING METHOD AND ELEMENT PRODUCING METHOD

(75) Inventors: Masahiro Morikawa, Tokyo (JP); Kazumi Furuta, Hino (JP); Osamu Masuda, Tokyo (JP); Akiko Kuji, Hachioji (JP)

(73) Assignee: Konica Corporation, Tokyo (JP)

( * ) Notice: Subject to any disclaimer, the term of this patent is extended or adjusted under 35 U.S.C. 154(b) by 148 days.

(21) Appl. No.: 10/230,790

(22) Filed: Aug. 29, 2002

(65) Prior Publication Data

US 2003/0044530 A1 Mar. 6, 2003

(30) Foreign Application Priority Data

Sep. 6, 2001 (JP) ..... 2001-270475

(51) Int. Cl.[7] ..... B05D 3/12

(52) U.S. Cl. ..... 427/240; 427/290; 427/292; 427/372.2; 427/425; 427/430.1; 118/52; 118/320

(58) Field of Search ..... 427/240, 425, 427/430.1, 402, 419.7, 387, 397.7, 162, 290, 292, 372.2; 118/52, 320

(56) References Cited

U.S. PATENT DOCUMENTS

| | | | | | |
|---|---|---|---|---|---|
| 4,267,208 | A | * | 5/1981 | Ireland | 427/154 |
| 4,895,102 | A | * | 1/1990 | Kachel et al. | 118/620 |
| 5,514,214 | A | * | 5/1996 | Joel et al. | 118/52 |
| 5,753,301 | A | * | 5/1998 | Brytsche et al. | 427/162 |
| 6,689,419 | B2 | * | 2/2004 | Itou | 427/240 |
| 2002/0041929 | A1 | * | 4/2002 | Magne | 427/240 |
| 2002/0170887 | A1 | * | 11/2002 | Furuta et al. | 219/121.19 |

* cited by examiner

*Primary Examiner*—Kirsten Jolley
(74) *Attorney, Agent, or Firm*—Frishauf, Holtz, Goodman & Chick, P.C.

(57) ABSTRACT

A method of coating a coating liquid on a base material having a curved surface portion, includes processes of: a coating process of coating a coating liquid on a base material; and a rotating process of rotating the base material coated with the coating liquid.

27 Claims, 25 Drawing Sheets

FIG. 8 ( A )
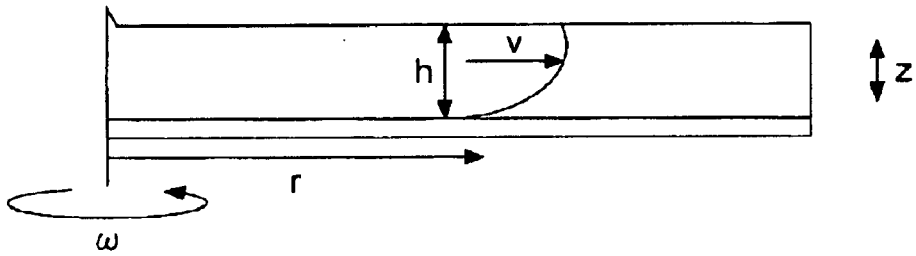
FIG. 8 ( B )
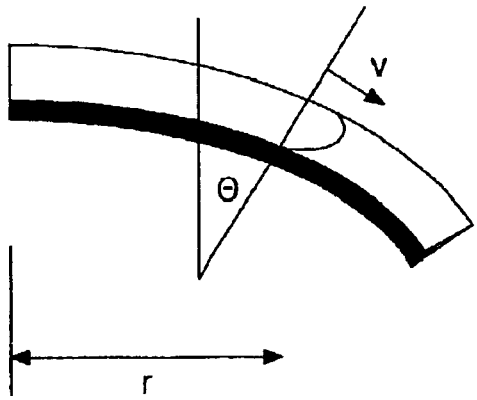

FIG. 10

S21

$$-\eta \frac{\partial^2 v}{\partial z^2} = \rho \omega^2 r \mathrm{Cos}[\theta] + \rho g \mathrm{Sin}[\theta]$$

S22

$$q = \int_0^h v dz = \frac{\rho \omega^2 r h^3}{3\eta} \mathrm{Cos}[\theta] + \frac{\rho g h^3}{3\eta} \mathrm{Sin}[\theta]$$

FIG. 12 ( A )
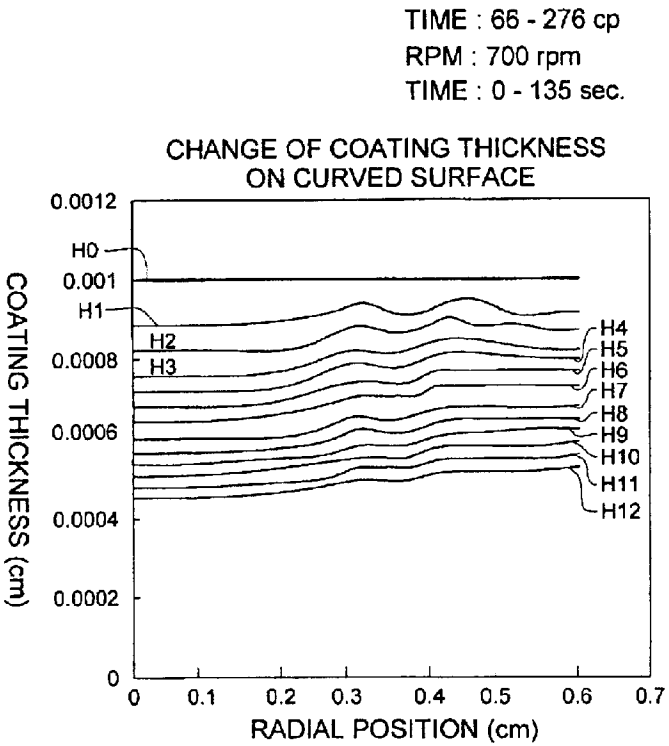
FIG. 12 ( B )
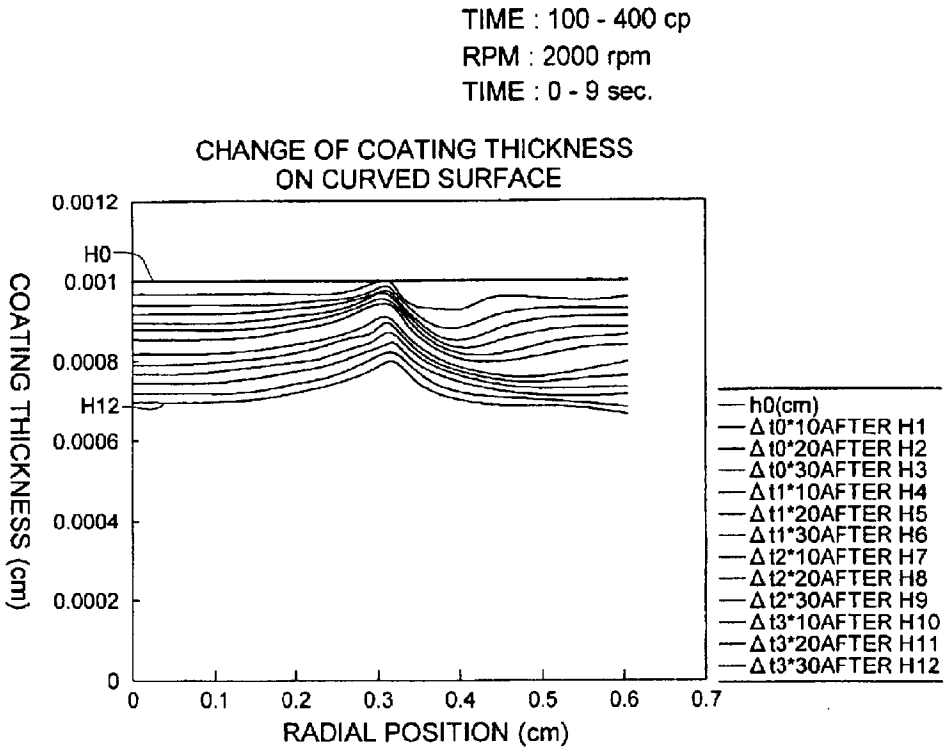

FIG. 20 ( A )
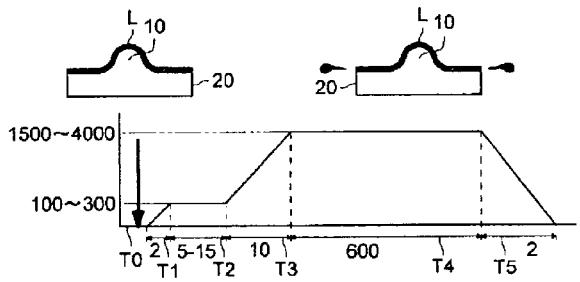
FIG. 20 ( B )
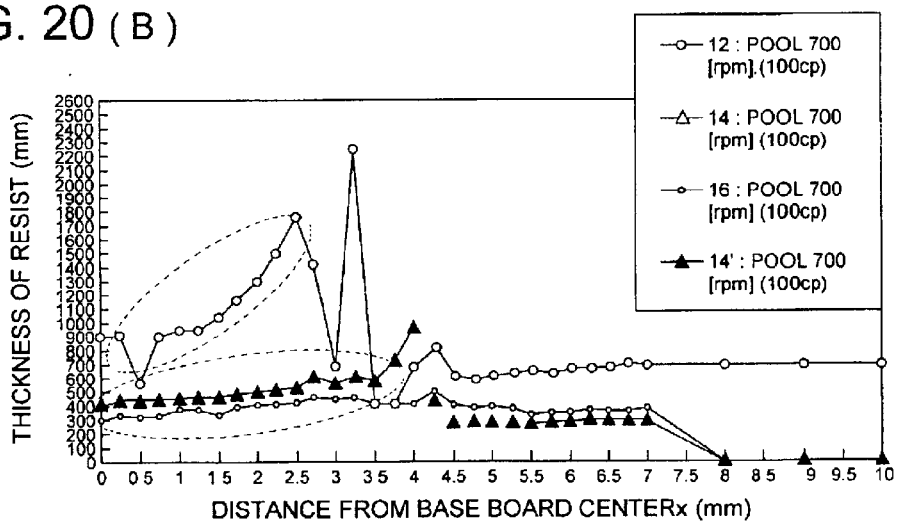
FIG. 20 ( C )
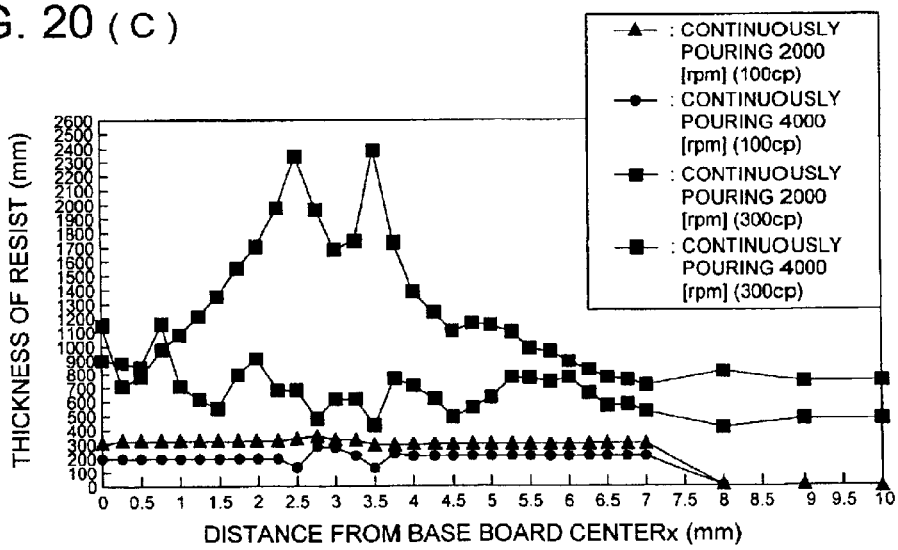

FIG. 22 ( A )
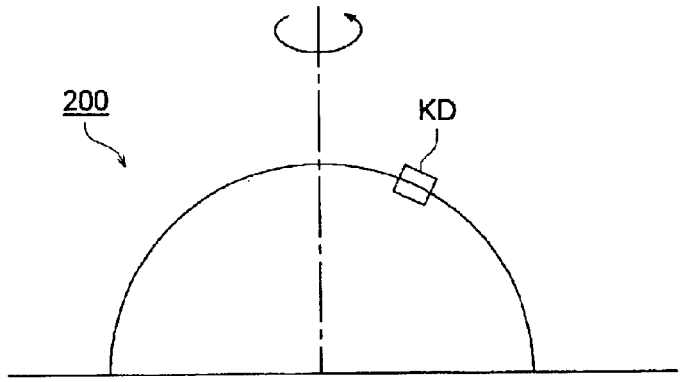
FIG. 22 ( B )
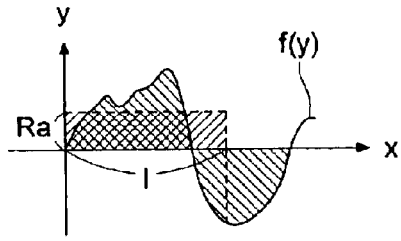
$$Ra = \frac{1}{l} \int_0^l |f(y)|\, dy$$
FIG. 22 ( C )
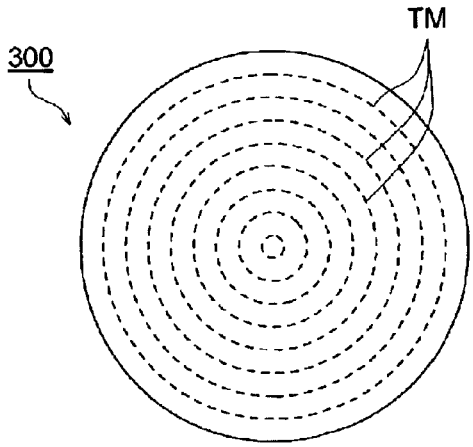

BASE MATERIAL TO BE COATED, COATING APPARATUS, COATING METHOD AND ELEMENT PRODUCING METHOD

BACKGROUND OF THE INVENTION

The present invention relates to a method of coating a coating material, a method of manufacturing an element, a base material to be coated, a method of manufacturing a base material to be coated and an apparatus of coating a coating material including a base material to be coated, and in particular, to those capable of coating a resist on a base material having a curved surface and obtaining uniform distribution of coating thickness.

There has been known the so-called spin coating for spin-coating a coating material such as a resist on a plane surface on a base material such as Si base plate, in, for example, light lithograph or EB (electronic beam) lithograph.

In this spin coating, a droplet of a resist solution is dropped on the neighborhood of the center of the base material in a flat board shape and the base material is rotated, thus, the resist is spread to coat on the surface of the base material by the centrifugal force caused by the rotation of the base material, and excessive resist is shaken off. Incidentally, the distribution of coating thickness of the resist on the base material is determined based on physical properties (viscosity, surface tension and others) of the resist and on a speed of rotation of a rotary member (spin coater) in the case of rotating the base material as well as ambient conditions (temperature and others).

In the spin coating described above, when one surface of the base material to be coated is a plane, it is possible to obtain the distribution of coating thickness which is mostly uniform. However, in the case of the same spin coating on the base material having a curved surface on one surface thereof, it has been impossible to obtain the uniform distribution of coating thickness. Namely, in the case of resist coating on base material 200 having a shape of a curved surface shown in FIG. 22(A), there have been caused areas having uneven coating thickness.

In addition, when conducting spin coating, a droplet of a resist solution is dropped on the surface of a base material, and then, the base material is rotated at a prescribed speed of rotation for preliminary spinning after the surface is covered, and after that, the regular spinning is conducted at a prescribed speed of rotation.

However, when spin coating has been conducted by the aforementioned method on a base material having a shape of the curved surface, there has been caused a problem that a coating thickness is small on the top portion of the base material, a tendency of monotone increase of coating thickness distribution becomes more conspicuous as the location moves from the rotational center of the base material to the peripheral portion, and the coating thickness cannot be make uniform.

In particular, a specific shape represented by a curved surface shape has made it impossible to remove the change in coating thickness resulting from an influence of gravity applied on the resist.

Further, for obtaining a desired coating thickness, it is conceivable that a resist coating process and a baking (heating) process are respectively repeated plural times. In this case, however, a difference of portions of uneven coating thickness was enlarged each time the process was repeated, because a portion of uneven coating thickness caused by nth resist coating was superposed on the area of uneven coating thickness caused by the first resist coating.

It is also conceivable that a flat portion is formed along the circumference of a curved surface portion of the base material to improve the flow of a droplet caused by centrifugal force, so that formation of uniform coating thickness is urged in spin coating. However, this method has caused a problem that a size of the base material (the basic material) in the manufacturing stage is large, resulting in increase of members to be used and increase of cost, and machining of a base material takes a long time, resulting in a long term of works.

Further, when obtaining a shape of the base material 200 through cutting by a general purpose lathe, plural lines TM in a shape of concentric circles which are called tool marks are undesirably formed, as shown in FIG. 22(C). That is, the base material chucked by a chuck on the lathe is rotated, and a tip of a cutting tool is brought into pressure contact with the rotating base material to cut the base material by moving continuously from the peripheral portion, thus, an area that is touched by the cutting tool is generated on the peripheral portion, and tool marks in the shape of concentric circles are formed on the surface of the base material.

Due to the tool marks thus formed, roughness caused by cutting by the cutting tool is reflected as it is as "surface roughness of the base material", and the surface roughness on the KD portion of base material 200 in FIG. 22, for example, becomes a surface form of the base material at about 600 (nm), for example, therefore, it is difficult to control displacement of coating thickness distribution obtained by coating resist finally to be less than allowable roughness. "Surface roughness" in this case means the one indicating value Ra obtained by the expression shown in the drawing, when a certain surface is defined as roughness curve f(y), then, a portion corresponding to measured length 1 in the direction to the center line is sampled from the roughness curve f(y), and when the roughness curve is expressed by x=f(y) with X axis representing the center line of the sampled portion and with Y axis in the direction of longitudinal magnification as shown in FIG. 22(B). Therefore, if the value Ra representing the surface roughness takes the value stated above, distribution of coating thickness of resist coating is also affected.

In particular, because of the tool marks which are formed, when measuring a coating thickness optically, light is subjected to diffused reflection by grooves of the tool marks, which has made it impossible to measure coating thickness and has caused troubles for measurement and evaluation of coating thickness.

SUMMARY OF THE INVENTION

The invention has been achieved in view of the circumstances mentioned above, and its first object is to provide a method of coating a coating material wherein an influence by monotonous increase of coating thickness caused by ordinary spin coat on the base material having a curved surface shape and an influence by gravity are reduced, and unevenness of coating thickness can be prevented by controlling a difference of uneven portions even when coating steps are repeated any number of times, a method of manufacturing an element, a base material to be coated, a method of manufacturing a base material to be coated and an apparatus of coating a coating material including a base material to be coated.

The second object of the invention is to provide a method of coating a coating material wherein a size of a base material is prevented from becoming large while spin coat is conducted properly, and shortening of a term of works can be achieved, a method of coating a coating material, a method of manufacturing an element, a base material to be coated, a method of manufacturing a base material to be coated and an apparatus of coating a coating material including a base material to be coated.

The third object of the invention is to provide a method of coating a coating material wherein it is possible to control final coating thickness distribution to be better than roughness allowable for final coating thickness distribution, and coating thickness can be measured and evaluated, a method of manufacturing an element, a base material to be coated, a method of manufacturing a base material to be coated and an apparatus of coating a coating material including a base material to be coated.

For attaining the objects stated above, the invention described in Item (1) is a method of coating a coating material in which a base material to be coated thereon with a coating material is rotated, and the coating material is coated on the base material to be coated having a curved surface portion on at least one surface thereof, wherein there are included a spin coating process in which the coating material is poured down continuously on the top portion of the curved surface portion of the base material to be coated, and the coating material poured down on the top portion flows down smoothly to be coated while keeping the mostly uniform coating thickness and advancing to the peripheral portion of the curved surface portion from the top portion under the condition of the rotation at the prescribed first speed of rotation of the base material to be coated, and a rotating process in which the continuous supply of the coating material is stopped, and the base material to be coated on which the coating material has been coated is rotated at the second speed of rotation that is greater than the first speed of rotation.

The invention described in Item (2) is a method of coating a coating material in which a base material to be coated thereon with a coating material is rotated, and the coating material is coated on the base material to be coated having a curved surface portion on at least one surface thereof, wherein there are included a spin coating process in which the coating material is poured down continuously on the top portion of the curved surface portion of the base material to be coated, and the coating material poured down on the top portion flows down smoothly to be coated while keeping the mostly uniform coating thickness and advancing to the peripheral portion of the curved surface portion from the top portion under the condition of the rotation at the prescribed first speed of rotation of the base material to be coated, and a rotary moving process in which the continuous supply of the coating material is stopped, and the base material to be coated is moved at the prescribed acceleration in the direction of the rotation axis on the side opposite to the side on which a coating thickness is formed, while the base material to be coated on which the coating material has been coated is being rotated at the second speed of rotation that is greater than the first speed of rotation.

The invention described in Item (3) is a method of coating a coating material in which a base material to be coated thereon with a coating material is rotated, and the coating material is coated on the base material to be coated having a curved surface portion on at least one surface thereof, wherein there is included a spin coating process in which the coating material is poured down continuously on the top portion of the curved surface portion of the base material to be coated, and the coating material poured down on the top portion flows down smoothly to be coated while keeping the mostly uniform coating thickness and advancing to the peripheral portion of the curved surface portion from the top portion under the condition of the rotation at the prescribed speed of rotation of the base material to be coated, and the base material to be coated is moved at the prescribed acceleration in the direction of the rotation axis on a side opposite to the side on which a coating thickness is formed during the aforesaid coating material is coated.

The invention described in Item (4) is characterized in that the movement at the aforementioned acceleration is conducted until the curved surface portion of the base material to be coated is covered entirely by the coating material, in the spin coating process.

The invention described in Item (5) is a method of coating a coating material in which a base material to be coated thereon with a coating material is rotated, and the coating material is coated on the base material to be coated having a curved surface portion on at least one surface thereof, wherein there are included a process where the base material to be coated is immersed in a solution tank containing the coating material with the top portion of the curved surface portion of the base material to be coated facing downward, a process where the base material to be coated immersed in the coating material with the top portion facing downward is rotated at the prescribed speed of rotation while being lifted up, and a process where the base material to be coated is heated, with the top portion thereof facing downward, at the prescribed temperature.

The invention described in Item (6) is characterized to further have a process to reverse the top portion of the base material to be coated on which the first layer of the coating material has been formed so that the top portion may face upward, a spin coating process in which the coating material is poured down continuously on the top portion of the curved surface portion from the upper portion of the first layer, and the coating material poured down on the top portion flows down smoothly to be coated for the second layer while keeping the mostly uniform coating thickness on the first layer and advancing to the peripheral portion of the curved surface portion from the top portion under the condition of the rotation at the prescribed first speed of rotation of the base material to be coated, a rotating process in which the continuous supply of the coating material is stopped, and the base material to be coated on which the coating material for the second layer has been coated is rotated at the second speed of rotation that is greater than the first speed of rotation, and a heating process to heat the base material on which the coating material for the second layer has been coated, at the prescribed temperature.

The invention described in Item (7) is characterized to further have a process to form the base material to be coated on which a coating with the desired coating thickness is formed after repetition of the spin coating process the rotating process and the heating process.

The invention described in Item (8) is characterized to further have a process to reverse the top portion of the base material to be coated on which the first layer of the coating material has been formed so that the top portion may face upward, a spin coating process in which the coating material is poured down continuously on the top portion of the curved surface portion from the upper portion of the first layer, and the coating material poured down on the top portion flows down smoothly to be coated for the second layer while keeping the mostly uniform coating thickness on the first layer and advancing to the peripheral surface portion of the curved surface portion from the top portion under the condition of the rotation at the prescribed first speed of rotation of the base material to be coated, and a rotary moving process in which the continuous supply of the coating material is stopped, and the base material to be coated is moved at the prescribed acceleration in the direction of the rotation axis on the side opposite to the side on which a coating thickness is formed, while the base material to be coated on which the coating material for the second layer has been coated is being rotated at the second speed of rotation that is greater than the first speed of rotation.

The invention described in Item (9) is characterized to further have a process to reverse the top portion of the base material to be coated on which the first layer of the coating material has been formed so that the top portion may face upward, and a spin coating process in which the coating material is poured down continuously on the top portion of the curved surface portion from the upper portion of the first layer, and the base material to be coated is moved at the prescribed acceleration in the direction of the rotation axis on the side opposite to the side on which a coating thickness is formed, while the coating material poured down on the top portion with the rotation of the base material at the prescribed speed of rotation is flowing down smoothly as it moves from the top portion to the peripheral surface portion of the curved surface portion while keeping the mostly uniform coating thickness on the first layer and the coating material for the second layer is being coated.

The invention described in Item (10) is characterized in that the first speed of rotation or the prescribed speed of rotation stated above is in a range of 200–700 rpm, in the spin coating process.

The invention described in Item (11) is characterized in that the second speed of rotation corresponds to the speed of rotation in which gravity and centrifugal force both applied on the coating material on the curved surface portion are balanced each other, in the rotating process or the rotary moving process.

The invention described in Item (12) is characterized in that the second speed of rotation is in the vicinity of 700 rpm, in the rotating process or the rotary moving process.

The invention described in Item (13) is characterized in that spin-coating is conducted for the coating material whose viscosity is the first viscosity in which gravity and centrifugal force both applied on the coating material on the curved surface portion are balanced each other, in the spin coating process.

The invention described in Item (14) is characterized in that the first viscosity is made to be about 150 (mPa·S) or less for coating, in the spin coating process.

The invention described in Item (15) is characterized in that the peripheral surface portion has a peripheral plane surface portion formed along the circumference of the curved surface portion and a peripheral curved surface portion that is formed on the boundary area between the peripheral plane surface portion and the curved surface portion so that the coating material may flow down smoothly, while, the spin coating process includes a process that the coating material is coated on the curved surface portion, the peripheral curved surface portion and the peripheral plane surface portion, while the coating material is flowing down smoothly from the curved surface portion to the peripheral plane surface portion through the peripheral curved surface portion.

The invention described in Item (16) is characterized in that the base material to be coated is made by resin and the coating material is coated in the spin coating process.

The invention described in Item (17) is characterized in that the base material to be coated is made by n-type silicone and the coating material is coated in the spin coating process.

The invention described in Item (18) is characterized in that the heating process in which the base material to be coated on which the coating material has been coated is heated at the prescribed temperature is further provided.

The invention described in Item (19) is a method of manufacturing an element for manufacturing the element that is composed of a curved surface portion formed on at least one surface and of a peripheral surface portion formed along the circumference of the curved surface portion, by applying the prescribed processing, wherein there are included a cutting process to cut by an ultra-high precision lathe with the first roughness necessary for processing the element in advance, by controlling the surface roughness of the curved surface portion, while controlling a feeding amount and a depth of cut and a grinding process to grind the curved surface portion.

The invention described in Item (20) is characterized in that the first roughness is made to be 20 nm or less for cutting, in the cutting process.

The invention described in Item (21) is characterized in that the cutting operation is conducted while temperature is being controlled, in the cutting process.

The invention described in Item (22) is characterized in that the form processing is conducted while cutting with a diamond tool, in the cutting process.

The invention described in Item (23) is characterized in that the tool marks are ground until a rainbow disappears, in the grinding process.

The invention described in Item (24) is a method of manufacturing an element for manufacturing the element to be coated with the coating material that is composed of a curved surface portion formed on at least one surface, a peripheral plane surface portion formed along the circumference of the curved surface portion, and a peripheral curved surface portion that is formed on a boundary area between the peripheral plane surface portion and the curved surface portion so that a coating material poured down continuously on the top portion of the curved surface portion responding to the rotation may flow down smoothly as advancing from the top portion to the peripheral portion of the curved surface portion, while keeping the mostly uniform coating thickness by applying the prescribed processing, wherein there are included a spin coating process in which the coating material is poured down continuously on the top portion of the curved surface portion, and the coating material is coated on the curved surface portion, the peripheral curved surface portion and the peripheral plane surface portion, while flowing down smoothly from the top portion toward the peripheral plane surface portion through the peripheral curved surface portion, a rotating process in which the continuous supply of the coating material is stopped, and the base material to be coated on which the coating material has been coated is rotated at the second speed of rotation greater than the first speed of rotation, a heating process in which the base material to be coated on which the coating material has been coated is heated at the prescribed temperature, and a process in which the peripheral plane surface portion and the peripheral curved surface portion on both of which the coating materials have been coated are cut.

The invention described in Item (25) is characterized in that a curved surface portion that is formed on at least one surface and is rotary-coated with a coating material and a peripheral surface portion that is formed so that the coating material may flow down smoothly as it advances from the top portion of the curved surface portion to the peripheral portion while keeping the mostly uniform coating thickness, responding to the spin-coating, are included, and a distance from the rotational center of the curved surface portion to an end of the circumference of the peripheral surface portion is made to be the length which is almost 4 times that of a radius of the curved surface portion.

The invention described in Item (26) is characterized in that a curved surface portion that is formed on at least one surface and is rotary-coated with a coating material and a peripheral surface portion that is formed so that the coating material may flow down smoothly as it advances from the top portion of the curved surface portion to the peripheral portion while keeping the mostly uniform coating thickness, responding to the spin-coating, are included, and an irregular portion (a concave/convex portion) for correcting coating thickness that corrects the coating thickness after coating of the coating material is formed at the position of a boundary area between the peripheral surface portion and the curved surface portion.

The invention described in Item (27) is characterized in that the peripheral surface portion includes a peripheral plane surface portion formed along the circumference of the curved surface portion and a peripheral curved surface portion that is formed on the boundary area between the peripheral plane surface portion and the curved surface portion, and the irregular portion for correcting the coating thickness is formed at the position of the boundary area between the peripheral curved surface portion and the curved surface portion.

The invention described in Item 28 is characterized in that the coating thickness correcting irregular portion is in a shape that absorbs an uneven portion formed at the boundary position of the first layer after coating of a coating material.

The invention described in Item 29 is characterized in that the coating thickness correcting irregular portion is in a shape that absorbs an uneven portion of all layers after coating of a coating material, in the case of plural coating operations of coating materials.

The invention described in Item 30 is characterized in that the curved surface portion includes an effective curved surface portion covering from the center of the top portion where the coating material flowing down sticks to the prescribed effective distance where the coating thickness after coating of a coating material needs to be almost uniform, first radius of the curved surface portion is formed to be in a size ranging from about the same size as, to about 10 times the second radius of the curved surface constituting the peripheral curved surface portion, and the boundary area between the peripheral plane surface portion and the peripheral curved surface portion where an inclination of the tangential line to the second radius is almost zero is formed at the position that is farther away by the distance which is at least twice the effective distance of the effective curved surface portion.

The invention described in Item 31 is characterized in that a shape that absorbs an uneven portion in accordance with characteristics of coating thickness distribution at the boundary area position is formed in advance in the coating thickness correcting irregular portion.

The invention described in Item 32 is a base material to be coated in which a curved surface portion is formed on at least one surface, and a coating material is coated on at least the curved surface portion, wherein the surface roughness of the curved surface is made to be the first roughness that is necessary to process the element in advance, so that the distribution of coating thickness that is formed on the curved surface portion may be within an allowable range of the prescribed roughness.

The invention described in Item 33 is characterized in that the first roughness is about 50 nm or less.

The invention described in Item 34 is characterized in that the first roughness is about 20 nm or less.

The invention described in Item 35 is characterized in that the base material to be coated is made of resin.

The invention described in Item (36) is a method of manufacturing a base material to be coated including a curved surface portion formed on at least one surface, a peripheral plane surface portion formed along the circumference of the curved surface portion, a peripheral curved surface portion that is formed on a boundary area between the peripheral plane surface portion and the curved surface portion so that a coating material poured down continuously on the top portion of the curved surface portion responding to the rotation may flow down smoothly as advancing from the top portion to the peripheral portion of the curved surface portion, and a coating thickness correcting irregular portion that is formed on the boundary area position between the peripheral plane surface portion and the curved surface portion and corrects a coating thickness after coating the coating material wherein, in a plurality of the base materials to be coated, the coating thickness of the coating material at each radial position is measured, an amount of displacement from the coating thickness that is the standard of the coating thickness is calculated, then, based on this calculation, a standard shape data of the coating thickness correcting irregular portion is prepared, and thereafter, when forming the coating thickness correcting irregular portion, the processing for the forming is conducted based on the standard shape data for the coating thickness correcting irregular portion.

The invention described in Item 37 is characterized in that the coating thickness at each radial position of the coating material is a coating thickness of the first layer after coating of the coating material.

The invention described in Item 38 is characterized in that the coating thickness at each radial position of the coating material is a coating thickness of all layers after coating of the coating material.

The invention described in Item 39 is characterized in that the coating thickness representing the standard is an average coating thickness of the coating materials in a range within a distance of about 1.8 mm from the central portion of the base material to be coated.

The invention described in Item 40 is characterized in that the base material to be coated that is described in either of the foregoing, a holding member to hold and rotate the base material to be coated, a spin driving means for driving the holding member to rotate under the state that the rotational center of the base material to be coated is almost aligned, a means to coat a coating material that coats the coating material, and a control means that controls an amount of coating from the means to coat a coating material, are included.

The invention described in Item 41 is characterized in that there is provided a speed of rotation control means that controls so that the base material to be coated may be rotated at the first speed of rotation when a coating material is made to flow down continuously on the base material to be coated, and the base material to be coated may be rotated at the second speed of rotation greater than the first speed of rotation after the coating material has been coated, and the control means controls the first and second speeds of rotation by the speed of rotation control means, depending on presence or absence of the supply of a coating material by the means to coat a coating material.

The invention described in Item 42 is characterized in that the speed of rotation control means controls the first speed of rotation to be within a range of 200–700 rpm.

The invention described in Item 43 is characterized in that the speed of rotation control means controls so that second speed of rotation corresponds to the speed of rotation in which gravity and centrifugal force both applied on the coating material on the curved surface portion are balanced each other.

The invention described in Item 44 is characterized in that the speed of rotation control means controls so that the second speed of rotation is made to be in the vicinity of 700 rpm.

The invention described in Item 45 is characterized in that a viscosity control means that adjusts and controls viscosity of a coating material to be supplied to the means to coat a coating material is provided, and the control means controls viscosity based on the speed of rotation by the spin driving means and on an amount of coating of the coating material.

The invention described in Item 46 is characterized in that the viscosity control means controls so that the viscosity of the coating material is made to be the first viscosity in which the gravity and centrifugal force both applied to the coating material on the curved surface are balanced with each other.

The invention described in Item 47 is characterized in that the viscosity control means controls so that the first viscosity may be 150 (mPa·S) or less.

The invention described in Item 48 is characterized in that a coating material supply time control means that adjusts and controls the time to supply coating materials supplied by the means to coat a coating material, is provided, and the control means controls the supply time so that the coating material may be supplied continuously for coating when coating the coating material.

The invention described in Item 49 is characterized in that an elevator means which moves the holding member up and down, and a gravity control means which controls gravity acting on coating materials, by controlling up and down motions of the elevator means while rotating the holding member, are further provided.

The invention described in Item 50 is characterized in that an upside-down reversing means that reverses the holding member upside down, a fixing means to fix the base material to be coated on the holding member, and a solution tank in which the base material to be coated held by the holding member is immersed into coating materials, are provided, and the control means controls so that the base material to be coated is fixed on the holding member by the fixing means, and is immersed in the solution tank under the condition that the top portion of the base material to be coated is made to face downward by the upside-down reversing means, and after that, the base material to be coated immersed in the coating material is lifted while it is rotated.

The invention described in Item 51 is characterized in that the holding member includes a first direction regulating section that regulates the first direction in which the centrifugal force generated by the rotation of the base material to be coated acts.

The invention described in Item 52 is characterized in that the holding member has a concave portion where the base material to be coated is placed, and the first direction regulating section is a side wall of the concave portion.

The invention described in Item 53 is characterized to include a base material to be coated including a curved surface that is formed on at least one surface and is subjected to spin-coating of a coating material, a holding member that holds and rotates the base material to be coated, a spin-driving means that spin-drives the holding member under the state to agree mostly with the rotational center of the base material to be coated, a means to coat a coating material that coats the coating material, a speed of rotation controlling means that controls the spin-driving means so that the base material to be coated may be rotated at the first speed of rotation when pouring down coating materials continuously on the base material to be coated, and the base material to be coated may be rotated at the second speed of rotation greater than the first speed of rotation after the coating material is coated, a coating material supply time control means that adjusts and controls the supply time for coating materials to be supplied by the means to coat a coating material, and a control means that controls the first and second speeds of rotation by the speed of rotation control means depending on presence or absence of the supply of coating materials by the means to coat a coating material, base on the supply time controlled by the coating material supply time control means.

The invention described in Item 54 is characterized to include a base material to be coated including a curved surface that is formed on at least one surface and is subjected to spin-coating of a coating material, a holding member that holds and rotates the base material to be coated, a spin-driving means that spin-drives the holding member under the state to agree mostly with the rotational center of the base material to be coated, a means to coat a coating material that coats the coating material, an elevator means that moves up and down the holding member that holds the base material to be coated, and a gravity control means that controls gravity acting on the coating on the coating material, by controlling up and down motions of the elevator means while rotating the holding member by the spin-driving means.

The invention described in Item 55 is characterized to include a base material to be coated including a curved surface that is formed on at least one surface and is subjected to spin-coating of a coating material, a holding member that holds and rotates the base material to be coated, a spin-driving means that spin-drives the holding member under the state to agree mostly with the rotational center of the base material to be coated, a means to coat a coating material that coats the coating material, an elevator means that moves up and down the holding member that holds the base material to be coated, an upside-down reversing means that reverses the holding member upside down, a fixing means to fix the base material to be coated on the holding member, and a solution tank in which the base material to be coated held by the holding member is immersed into coating materials, and the control means controls so that the base material to be coated is fixed on the holding member by the fixing means, and is immersed in the solution tank under the condition that the top portion of the base material to be coated is made to face downward by the upside-down reversing means and the elevator means, and after that, the base material to be coated immersed in the coating material is lifted by the elevator means while it is rotated.

BRIEF DESCRIPTION OF THE DRAWINGS

Each of FIGS. 8(A) and 8(B) shows an illustration for illustrating the mechanism of spin-coating, and FIG. 8(A) shows an occasion of a plane surface and FIG. 8(B) shows an occasion of a curved surface.

FIG. 10 is an illustration showing the relational expression for illustrating the mechanism of spin-coating on the curved surface.

FIG. 11(A) shows the relationship between the distance from the center and a height, FIG. 11(B) shows an occasion of 700 rpm, FIG. 11(C) shows an occasion of 800 rpm, and FIG. 11(D) shows an occasion of 600 rpm.

FIGS. 12(A) and 12(B) show illustrations for explaining aging changes of coating thickness on the curved surface caused by differences of viscosity and speed of rotation, and FIG. 12(A) shows an occasion of 700 rpm, while FIG. 12(B) shows an occasion of 2000 rpm.

FIGS. 20(A)–20(C) represent illustrations for explaining relationship between a distance from the center of a base board and a coating thickness in the case of starting spinning from the state where a solution of resist is deposited on the base board.

Each of FIGS. 21(A)–21(F) is an illustration for explaining total processing procedures in the case of forming a metal mold for molding by using base materials.

FIG. 22(A) is an illustration showing the processing in the conventional resist coating apparatus, FIG. 22(B) is an illustration for explaining the surface roughness, and FIG. 22(C) is an illustration for explaining the state wherein tool marks are formed.

Figure 23:
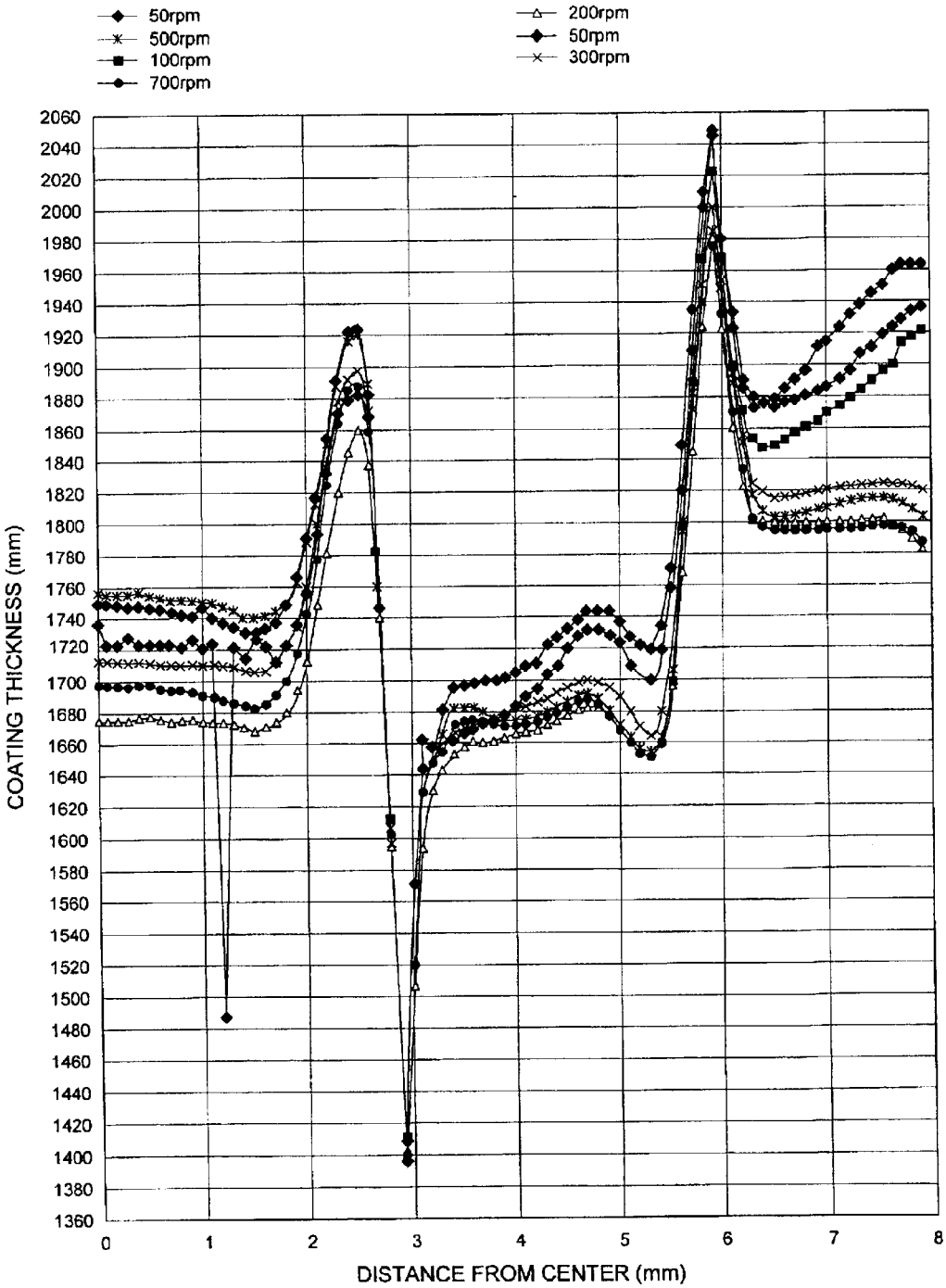

FIG. 23 is an illustration showing the relationship between the speed of rotation in the case of changing the speed of rotation in the course of preliminary spinning and the distribution of coating thickness of resist.

Figure 24:
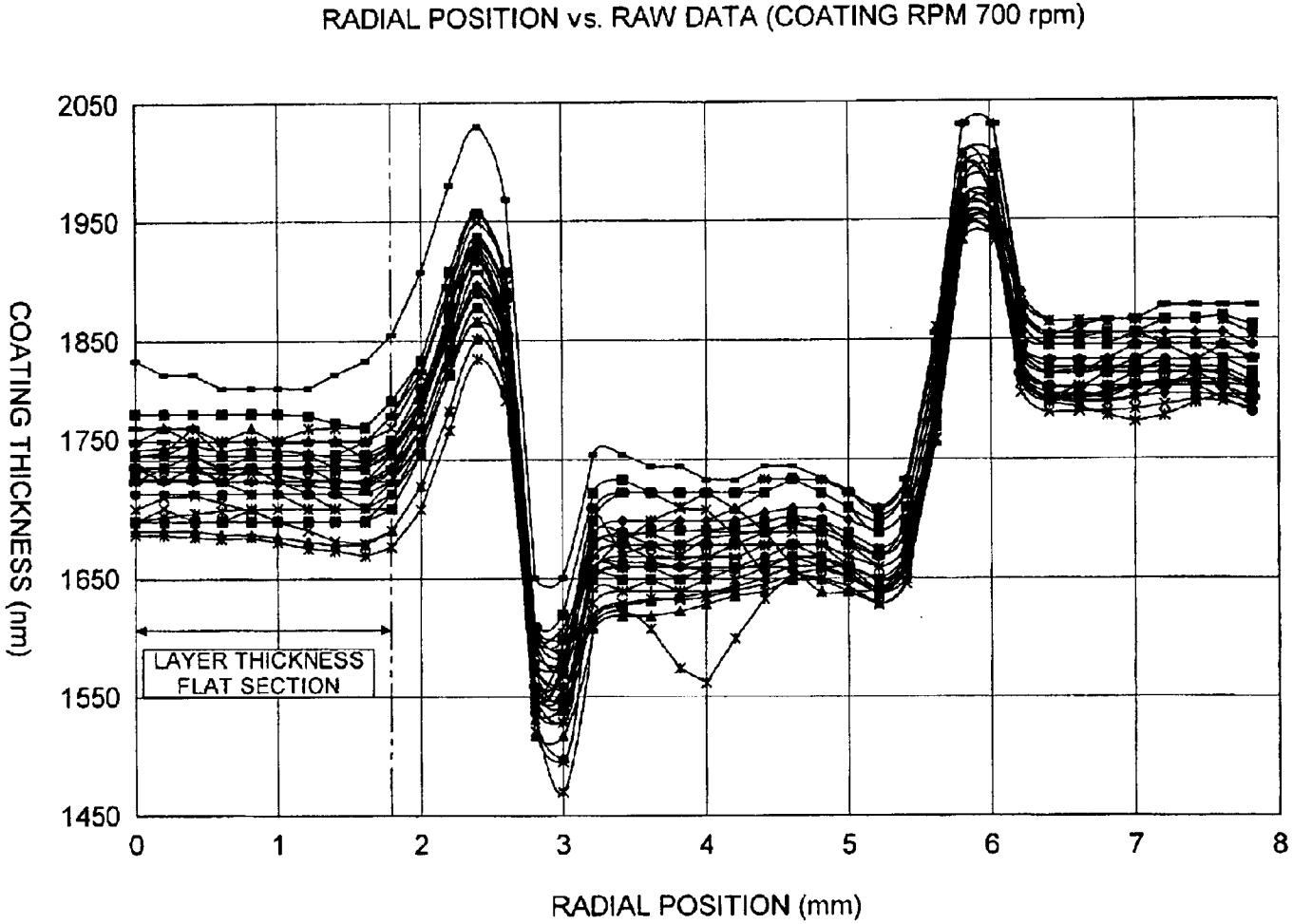

FIG. 24 is an illustration showing the distribution of coating thickness of resist of the plural base materials to be coated with resist.

Figure 25:
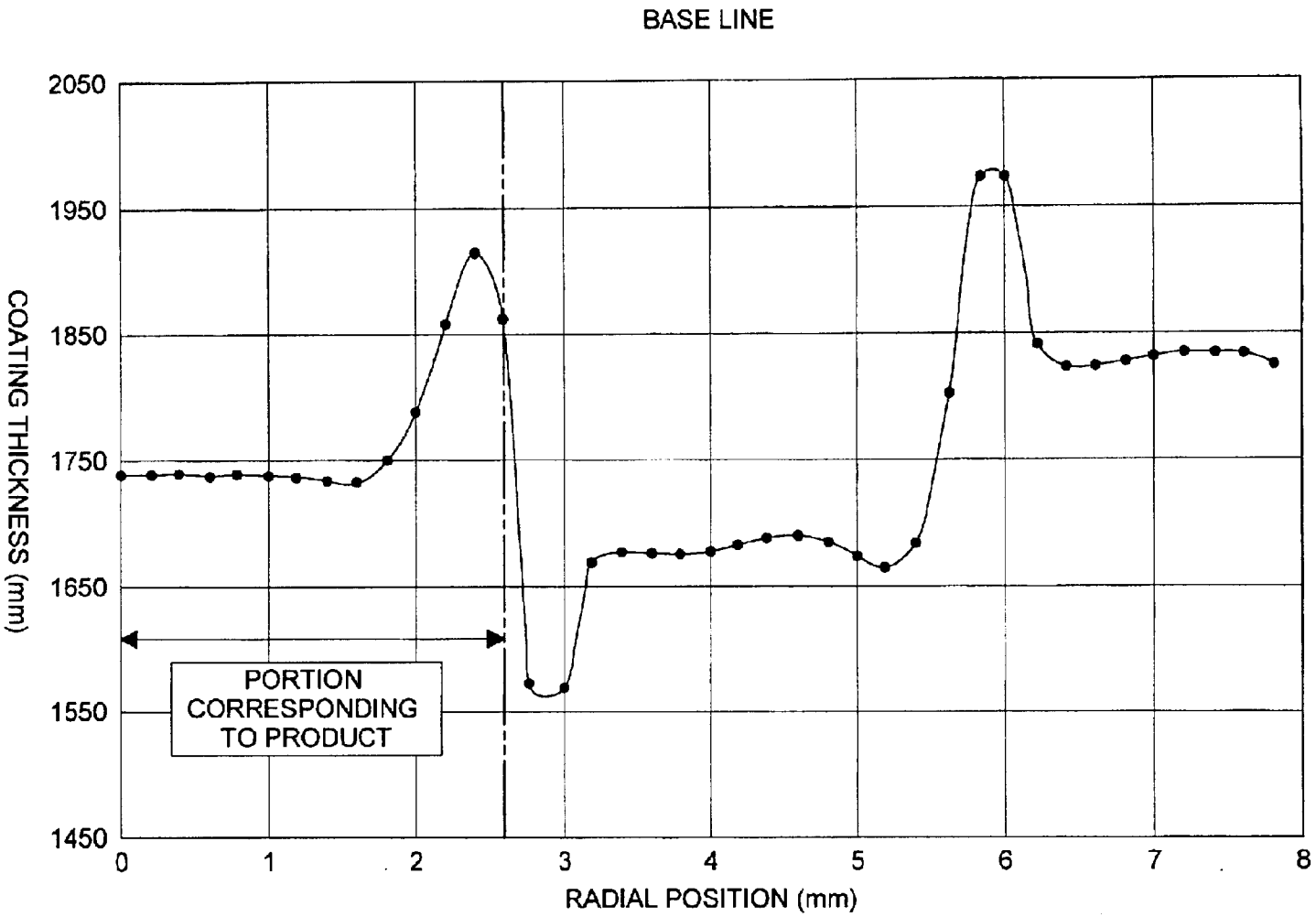

FIG. 25 is an illustration showing a base line representing the average value obtained by calculating an amount of displacement from the prescribed standard value in the distribution of coating thickness of resist of the plural base materials to be coated with resist shown in FIG. 24.

Figure 26:
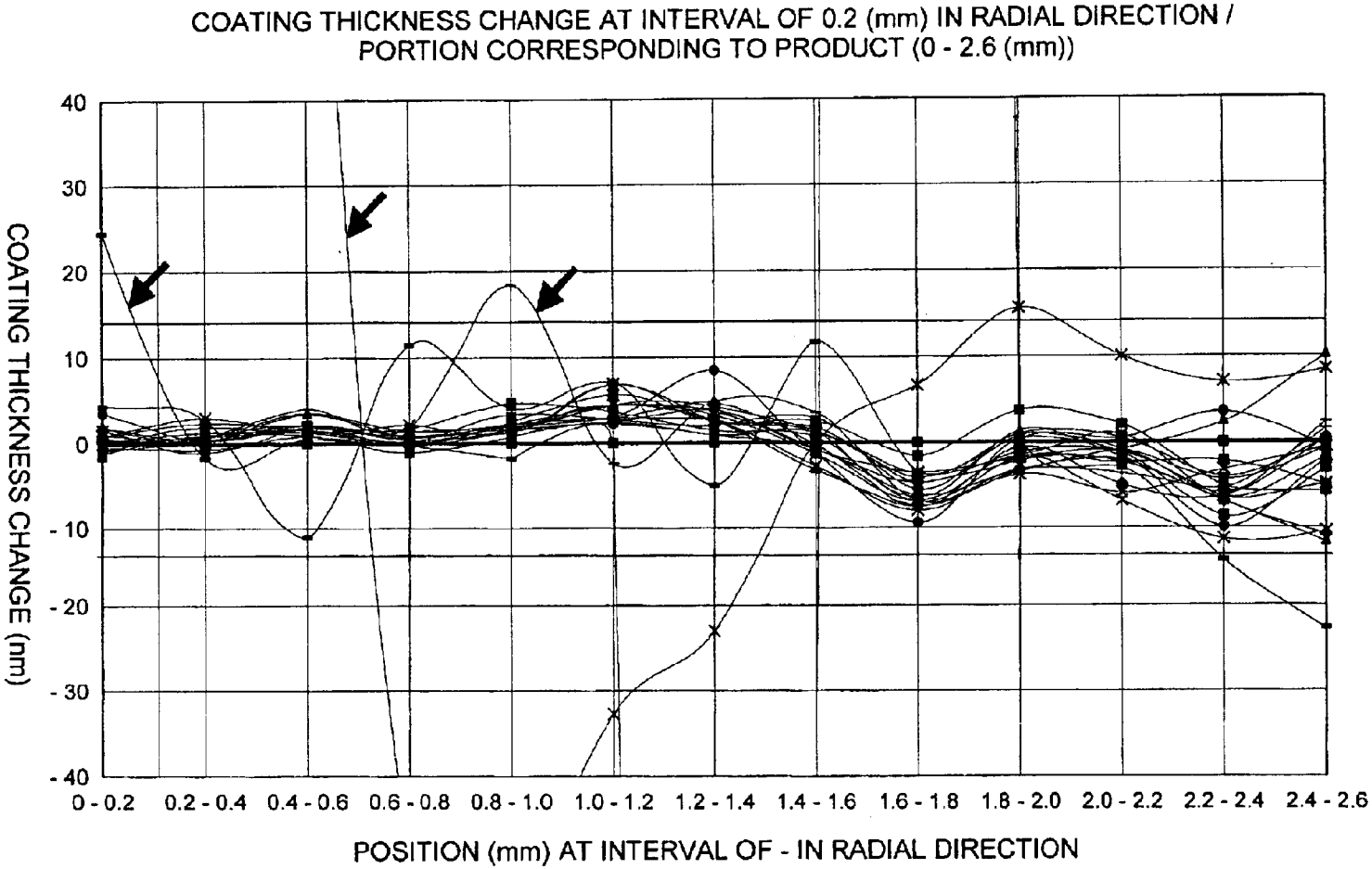

FIG. 26 is an illustration showing an error in the form of the resist coating thickness distribution of the plural base materials to be coated with resist shown in FIG. 24, which is calculated based on the base line shown in FIG. 25.

Figure 27:
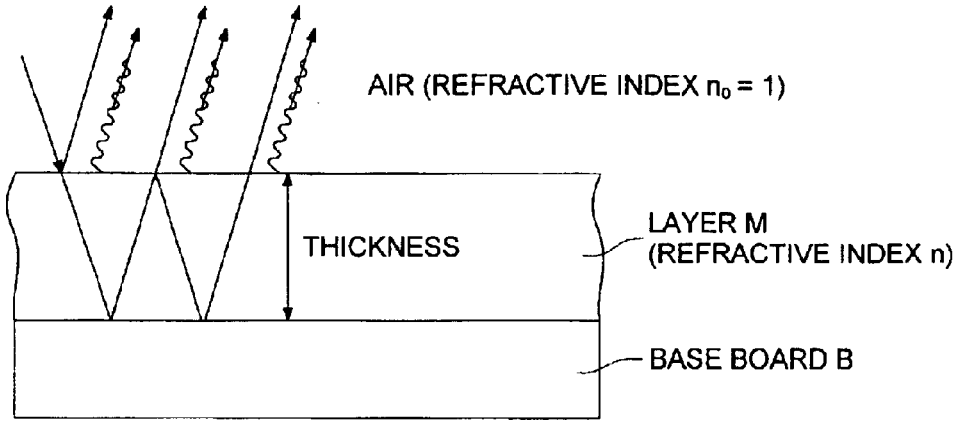

FIG. 27 is an illustration for explaining the method of measuring the coating thickness of resist covered by the base material to be coated with resist.

Figure 28:
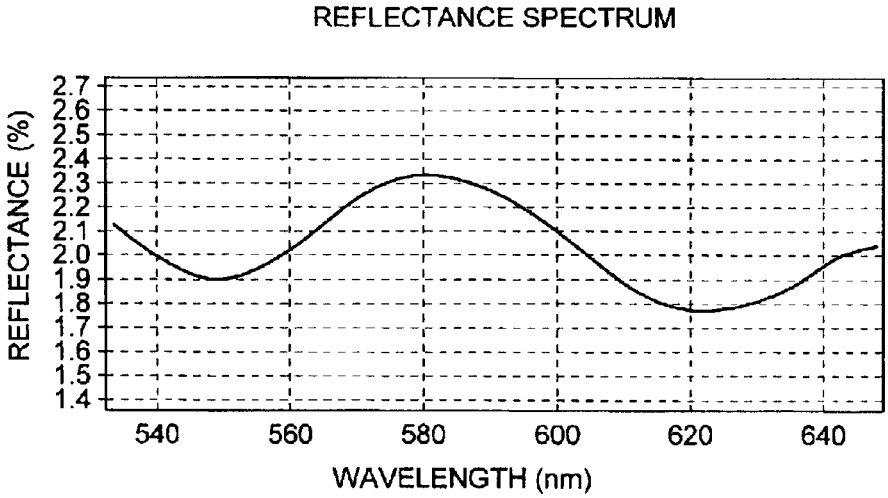

FIG. 28 is an illustration showing those subjected to the spectrum (reflectance spectrum) analyses of the reflected light in the state shown in FIG. 27.

DETAILED DESCRIPTION OF THE PREFERRED EMBODIMENT

An example of the preferable embodiment of the invention will be explained concretely as follows, referring to the drawings.

(First Embodiment)

(Overall Structure of the Apparatus of Coating a Coating Material)

Figure 1:
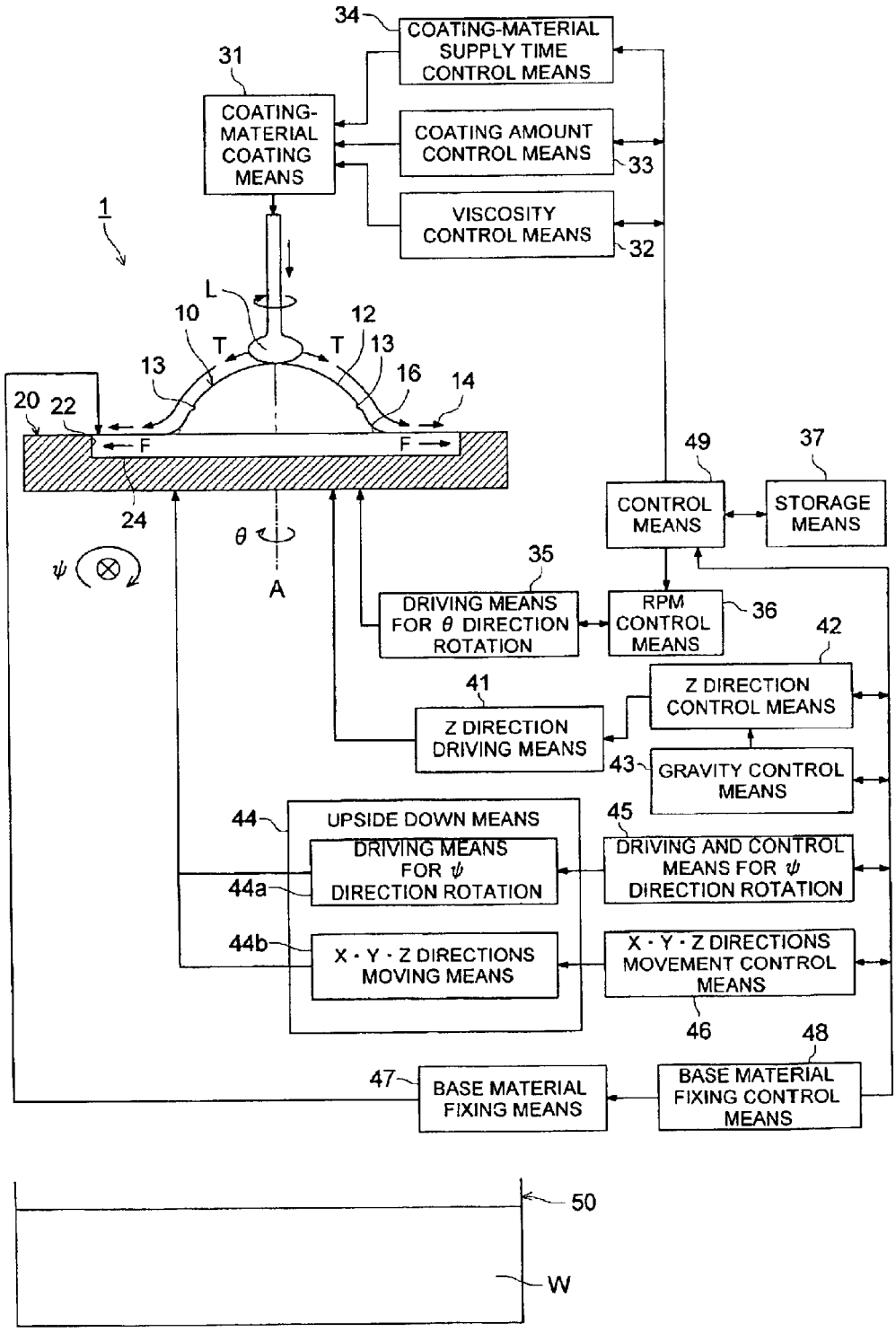
FIG. 1 is an illustration showing an example of the total schematic structure of the apparatus of coating a coating material of the invention.

First, prior to the explanation of the structure of a base material to be coated representing the characteristic structure of the invention, there will be explained the overall schematic structure of a resist coating apparatus wherein "the apparatus of coating a coating material" mentioned in the invention is applied to "the resist coating apparatus", referring to FIG. 1. FIG. 1 is a functional block diagram showing the overall schematic structure of the resist coating apparatus in the present embodiment.

Resist coating apparatus 1 (apparatus of coating a coating material) of the present embodiment has therein, as shown in FIG. 1, spin coater chuck 20 representing a holding member that holds and rotates, on rotation axis A, base material to be coated with resist 10 representing a base material to be coated which is coated with a coating material such as, for example, resist, coating material coating means 31 that coats resist by pouring down continuously the resist (L shown in FIG. 1) representing a coating material from the upper position on the base material to be coated with resist 10 at the position of rotational center axis A, viscosity control means 32 that controls viscosity of the resist stated above, coating amount control means 33 that adjusts and controls an amount of resist coated by the coating material coating means 31, coating material supply time control means 34 that controls the time of supplying resist when pouring down the resist continuously, θ direction spin-driving means 35 representing a spin-driving means for spin-driving the spin coater chuck 20 in the θ direction around the rotational center axis A, speed of rotation control means 36 that controls the speed of rotation of the spin coater chuck 20 when it is rotated by the θ direction spin-driving means 35, and storage means 37 that stores the correlative table showing the correlative relationship between the prescribed amount of resist and the speed of rotation, for example, for making the coating thickness of coated resist to be almost uniform, and various control conditions information such as condition information including ambient conditions such as, for example, temperature conditions.

Further, the resist coating apparatus 1 has therein Z direction driving means 41 representing an elevator means to drive to move the spin coater chuck 20 up and down in Z direction representing the vertical direction, Z direction control means 42 that controls driving of the Z direction driving means 41, gravity control means 43 that controls movement in the vertical direction to remove an influence of gravity in the case of flowing down of resist and controls by giving instructions to the Z direction control means 42, ψ direction spin-driving means 44*a* included in upside-down reversing means 44 for spin-driving (in other words, reversing upside down) in ψ direction under the condition that the spin coater chuck 20 is fixed in the base material 10, XYZ directions moving means 44*b* (included in the upside-down reversing means 44) for moving the spin coater chuck 20 slightly while holding the base material 10 in XYZ directions relating to the upside-down reversing, ψ direction spin-driving control means 45 that controls spin-driving of the ψ direction spin-driving means 44*a*, XYZ directions movement control means 46 that controls movements in XYZ directions of the XYZ directions moving means, base material fixing means 47 for fixing the base material 20 (for example, for fixing the base material 20 through vacuum attraction by providing a hole portion) even when the spin coater chuck 20 is reversed, base material fixing control means 48 that controls mounting and dismounting of the spin coater chuck 20 for the base material 10 by the base material fixing means 47, control means 49 that conducts overall control for the aforementioned various parts such as the coating amount control means 36 and the speed of rotation control means 32, and dip tank 50 representing a solution tank into which the base material 10 is immersed when the spin coater chuck 20 is reversed upside down and is lowered.

Incidentally, for controlling an ambient condition that is one of control conditions for resist coating such as, for example, a temperature condition so that the coating thickness may be almost uniform, the resist coating apparatus 1 is naturally provided with an unillustrated temperature control means that is linked to the control means 40. Further, as a temperature control condition, it is preferable to control by setting a range of 22–24° C., for example, and a range of 100–200° C. for baking.

Base material 10 to be coated with resist is structured by including curved surface portion 12 that is formed with preferable material for forming a lens such as, for example, resin member such as, for example, polyolefin, and is formed to be almost in a semicircular shape in terms of a sectional view to constitute a curved surface, peripheral plane surface portion 14 formed along the peripheral area of the curved surface portion 12, and peripheral curved surface portion 16 that is formed so that an area between the curved surface portion 12 and the peripheral plane surface portion 14 may be a smooth curved surface. Incidentally, the peripheral plane surface portion 14 and the peripheral curved surface portion 16 in the present example constitute "peripheral surface portion" of the invention. Although the curved surface is shown as a convex surface in the FIG. 1, it may be possible to form the curved surface in a concave surface.

For spin-holding the base material to be coated with resist 10, the spin coater chuck 20 has therein the first direction regulating portion that regulates movement in the first direction F in which the centrifugal force is generated by rotation, by regulating a peripheral portion of the base material to be coated with resist 10, or concave side wall portion 22 representing a chuck portion for chucking the base material to be coated with resist 10 and concave bottom wall portion 24 that holds the bottom surface of the base material to be coated with resist 10 by gravity, and the spin coater chuck 20 is formed to be concave in terms of its section. Namely, the spin coater chuck 20 is formed to have a concave portion.

Incidentally, in addition to the θ direction spin-driving means 35 and Z direction driving means 41, and X direction driving means and a Y direction driving means (not shown) both drive the spin coater chuck 20 to move respectively in the X direction and the Y direction on the XY plane constituting the surface to be coated with resist, and each adjustment mechanism (not shown) in each direction (θ direction, Z direction, X direction and Y direction) for conducting alignment operation for the spin coater chuck 20 at the position for resist coating after the spin coater chuck 20 holding the base material to be coated with resist is conveyed from the prescribed chucking position to the resist coating position, are included.

Control means 49 controls viscosity based on the speed of rotation by the θ direction spin-driving means 35 and on an amount of resist coated. It also controls the first and second speeds of rotation by the speed of rotation control means 36 in accordance with presence or absence of the supply of coating materials by the coating material coating means 31 based on the supply time controlled by the coating material supply time control means 34. Further, it controls going up and down by Z direction driving means 41 while the spin coater chuck 20 is rotated by the θ direction spin-driving means 35, after the resist is supplied continuously by the coating material coating means 31, and thereby, there is controlled gravity acting on resist by gravity control means 47. Furthermore, while the base material to be coated with resist 10 is fixed on the spin coater chuck 20 by base material fixing means 47, the top portion of the base material to be coated with resist 10 is made to face downward by the Z direction driving means 41 and is immersed into the dip tank 50, and after that, the base material to be coated with resist 10 dipped in the resist is controlled to be lifted by the Z direction driving means 42 while it is rotated under the condition that the top portion thereof faces downward.

The resist coating apparatus 1 having the aforementioned structure operates approximately as follows. Namely, in the resist coating apparatus 1 of the present embodiment, there are provided first processing procedures "to supply resist continuously in the course of preliminary spinning, and to conduct regular spinning" and second processing procedures "to immerse in a solution tank with the top portion of the curved surface portion facing downward, and then, to lift it for regular spinning", which will be described in detail later in the item of "processing procedures" which will be stated later.

Therefore, when trying to conduct resist coating with the first processing procedures, coating material coating means 3 first makes resist L to flow down continuously on base material to be coated with resist 10 while spin coater chuck 20 is rotated by θ direction driving means 35 in the case of the first rotation called "preliminary spin". In this case, various types of control information are programmed in storage means 37 so that driving control may be made at timing shown in FIG. 16, for example, and based on that control information, control means 49 gives instructions so that resist may be supplied from coating material coating means 31 for a certain period of time in the preliminary spin by coating material supply time control means 34, then, it gives an instruction (supplying control signals) to speed of rotation control means 36 so that θ direction spin driving means 35 may rotate at the prescribed first speed of rotation (for example, 200 rpm), and it further controls coating amount control means 33 and viscosity control means 32 so that an amount of coated resist and viscosity may be controlled.

However, with regard to the prescribed first speed of rotation, it is preferable that an appropriate value is selected to be used within a range of 200–700 rpm that is slower than the second speed of rotation in the "regular spin" described later according to a coating amount and viscosity of resist L.

In the detailed description of this point, the reason why the upper limit of the prescribed first speed of rotation is 700 rpm is that the purpose of the preliminary spin is to rotate the base material to be coated with resist 10 at the speed of rotation that is slower than that for "regular spin" described later and thereby to coat resist L widely and roughly on the base material to be coated with resist 10 by pouring down resist L continuously on the base material to be coated with resist 10, and the speed of rotation of the "regular spin" is about 700 rpm, as stated later (the reason for this will be explained later). Further, the reason why the lower limit of the prescribed first speed of rotation is 200 rpm is that when the speed of rotation in the preliminary spin, namely, the prescribed first speed of rotation was changed to 50 rpm, 100 rpm, 200 rpm, 300 rpm, 500 rpm and 700 rpm as shown in FIG. 23, coating thickness distribution of the final resist L on the base material to be coated with resist 10 (coating thickness distribution of resist L obtained by repeating the process of spin-coating of a resist solution and the baking process described later) showed insufficient uniformity under the condition that the prescribed first speed of rotation was not more than 100 rpm. To be concrete, in the range where the measurement position from the central portion of the base material to be coated with resist 10 exceeded 3 mm, in particular, remarkable ununiformity was observed, compared with occasions of other speeds of rotation, and even in the other measurement positions (range of 0–3 mm), ununiformity was observed on coating thickness distribution, compared with occasions of other speeds of rotation. The reason for this is considered that the action of the centrifugal force is weakened by the reduction of the speed of rotation and thereby, the speed of coating resist 2 widely to the peripheral portion is lowered, resulting in that resist L is dried and hardened before it is coated widely to the peripheral portion. Further, in the latter, an influence of the former is mainly considered. Incidentally, the range where the measurement position from the central portion of the base material to be coated with resist 10 exceeds 3 mm is a portion that is out of a range used actually, namely, a portion corresponding to product (actually, a portion of about 0–2.6 mm), and ununiformity of coating thickness distribution of this portion is apt to be considered to have no connection with the product. However, the range used actually, namely, the portion corresponding to product (range of 0–2.6 mm) is also influenced, for which some action needs to be taken. Therefore, in the present embodiment, the prescribed first speed of rotation is made to be 200 rpm or more to ensure the action of the centrifugal force to be the necessary minimum or more, and thereby to prevent that resist L is dried before it is coated widely to the peripheral portion, so that coating thickness distribution of base material to be coated with resist 10 may be the same (uniform) as that for other speeds of rotation (200 rpm or more) for all ranges including the portion corresponding to product (range of 0–2.6 mm for measurement position). Incidentally, ununiformity of coating thickness distribution is sometimes caused depending on a coating amount of resist or viscosity, even when the prescribed speed of rotation is in the range of 200–700 rpm. It is therefore preferable that an appropriate value is selected within a range of 200–700 rpm in accordance with the foregoing to be used, with respect to the first speed of rotation in preliminary spin.

Next, in the case of the second speed of rotation called "regular spin", spin coater chuck 20 is rotated by θ direction spin-driving means 35, after a resist solution poured down continuously by coating material coating means 31 is stopped. In this case, control means 49 gives an instruction so that coating material supply time control means 34 may control so that resist may not be supplied for a certain period of time, and gives an instruction to speed of rotation control means 36 so that θ direction spin-driving means 35 may spin-drive at the second speed of rotation that is greater than the first speed of rotation. Incidentally, the reason why the second speed of rotation is made to be 700 rpm will be described later.

In addition, in the present embodiment, when conducting "regular spin", spin coater chuck 20 is rotated while it is being moved downward at the prescribed acceleration (for example, 9.8 (m/(sec$^2$)) by Z direction driving means 41. In this case, control means 49 controls Z direction control means 42 so that gravity control means 43 may generate acceleration corresponding to the speed of rotation, and responding to this, the Z direction driving means 41 drives at the necessary acceleration, and thereby, the spin coater chuck 20 is moved. By doing this, it is possible to reduce an influence of gravity exerted when resist flows down.

On the other hand, when trying to conduct resist coating in accordance with the second processing procedures, base material to be coated with resist 10 is immersed in solution W in dip tank 50 under the condition that the base material to be coated with resist 10 is made to face downward by upside-down reversing means 44. In this case, base material fixing means 47 fixes the base material to be coated with resist 10 and spin coater chuck 20 so that the base material to be coated with resist 10 will not come off the spin coater chuck 20. Then, ψ direction spin-driving means 44*a* rotates the spin coater chuck 20, and XYZ directions moving means 44*b* moves the spin coater chuck 20 downward toward the dip tank 50.

Next, after the base material to be coated with resist 10 is immersed in the solution W, the spin coater chuck 20 is lifted by the XYZ directions moving means 44*b*, and is driven to rotate at the prescribed third speed of rotation (for example, 700 rpm) for "regular spin" by θ direction spin-driving means 35 under the condition that the base material to be coated with resist 10 faces downward. After that, baking (heating) processing is conducted at the prescribed temperature. With this baking (heating) processing, it is possible to conduct a hardening process to harden a coating liquid. As a more concrete method, it may be possible to apply a ultraviolet ray hardening process in accordance with the kind of the coating liquid other than the baking processing. Incidentally, the reason why the third speed of rotation is made to be about 700 rpm is the same as the reason why the second speed of rotation is made to be about 700 rpm, and both of them will be described later.

Then, after the base material to be coated with resist 10 is made to face upward by the ψ direction spin-driving means 44*a*, there is conducted "preliminary spin" wherein coating material coating means 31 pours down resist L continuously to the base material to be coated with resist 10 while the spin coater chuck 20 is rotated by the θ direction spin-driving means 35. In this case, the control means 49 gives instructions so that resist may be supplied by coating material coating means 31 for a certain period of time in the course of preliminary spin owing to coating material supply time control means 34, and gives instructions (supply control signals) to speed of rotation control means 36 so that the θ direction spin-driving means 35 may rotate at the prescribed fourth speed of rotation (for example, 200 rpm), and it further controls coating amount control means 33 and viscosity control means 32 so that an amount of resist coated and viscosity may also be controlled. Incidentally, with regard to the fourth speed of rotation, an appropriate value is selected and used in the range of 200–700 rpm that is smaller than the fifth speed of rotation, which is the same as in the prescribed first speed of rotation.

Further, after resist solution poured down continuously by the coating material coating means 31 is stopped, there is conducted "regular spin" the spin coater chuck 20 is rotated by the θ direction spin-driving means 35. In this case, the control means 49 gives instructions so that the coating material supply time control means 34 may control so that resist may not be supplied for a certain period of time, and it gives instructions to speed of rotation control means 36 so that the θ direction spin-driving means 35 may spin-drive at the fifth speed of rotation (for example, 700 rpm) which is greater than the fourth speed of rotation. Incidentally, the reason why the fifth speed of rotation is made to be about 700 rpm is the same as the reason why the second speed of rotation is made to be about 700 rpm, and both of them will be described later.

(Structure of Base Material to be Coated with Resist)

Figure 2:
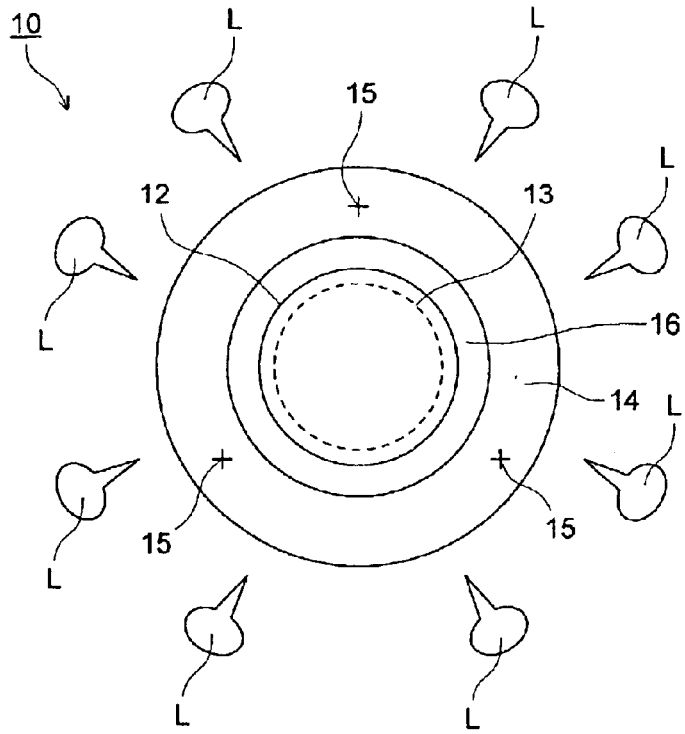
FIG. 2(A) is a top view showing a base material to be coated with resist processed by the resist coating apparatus shown in FIG. 1.
FIG. 2(B) is a schematic illustration showing a partial section of the base material to be coated with resit.
Figure 2:
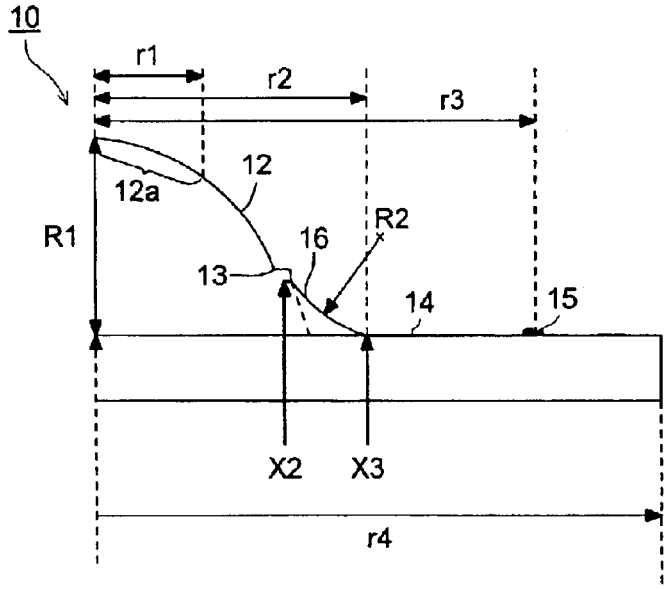

Next, practical structure of base material to be coated with resist 10 on which a resist solution is coated will be explained as follows, referring to FIG. 1–FIG. 3.

The base material to be coated with resist 10 in the present embodiment is one to be spin-coated with resist after being subjected to surface treatment that is conducted to give the base material to be coated with resist 10 the affinity with resist, and it is composed of curved surface portion 12, peripheral plane surface portion 14 and peripheral curved surface portion 16.

Figure 3:
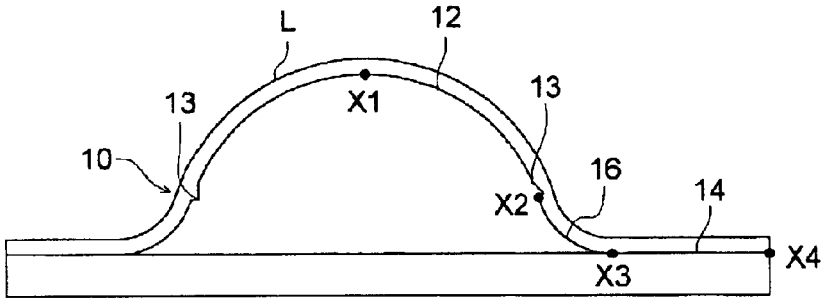
FIG. 3 is an illustration showing an example of a processing step for the base material to be coated with resist processed by the resist coating apparatus in FIG. 1.

To be concrete, as shown in FIG. 3, a curved surface, for example, an area from top portion of spherical surface X1 (top portion of base material to be coated with resist 10) to X2 is assumed to be curved surface portion 12, a peripheral area formed along the circumference of the curved surface portion 12 representing a spherical surface from periphery X4 of the base material to be coated with resist 10 to X3, on the other hand, is assumed to be peripheral plane surface portion 14, and a boundary area between peripheral plane surface portion 14 from X2 to X3 and the curved surface portion 12 is assumed to be peripheral curved surface portion 16. Due to this, resist is coated on the curved surface portion 16, the peripheral curved surface portion 16 and on peripheral plane surface portion 14 through peripheral curved surface portion 16.

The curved surface portion 12 includes effective curved surface portion 12*a* covering from the center of the top portion where flowing down resist sticks up to the prescribed effective distance r1 where coating thickness after resist coating needs to be almost uniform (in FIG. 2(B), an area on one side only is illustrated for simplifying explanation, and "distance" in the present example means a radius. In the case of a spherical surface, however, there is no difference even if "distance" is replaced with a terminology that means a diameter, because doubled radius is a diameter conceptually) as shown in FIG. 2(B). Incidentally, the curved surface portion 12 is not limited to the spherical surface shown in FIG. 2(B), but it may be all other curved surfaces representing aspheric surfaces.

Owing to the peripheral plane surface portion 14 provided, a resist solution is scattered around by centrifugal force, and it can flow down while keeping coating thickness uniformity.

Further, the peripheral plane surface portion 14 has position recognizing section 15 for recognizing the position of base material to be coated with resist 10 itself, as shown in FIG. 2(A). There are formed plural (for example, 3) position recognizing sections 15, and in the present example, convex portions each having a convex section are provided as shown in FIG. 2(B). Due to this, it is possible to recognize a position for the succeeding step such as, for example, a position for the exposure even if the surface of the peripheral plane surface portion 14 is covered with resist.

Namely, to be more concrete, owing to the measure to prevent resist from being coated widely to the position recognizing section 15 of the peripheral plane surface portion 14, recognizing accuracy of the position recognizing section 15 is improved, and accuracy of positioning for the exposure unit in the succeeding step and for the EB (electronic beam) drawing unit can be improved. Incidentally, it is preferable that the position recognizing section 15 is formed, as an arrangement position, at position r3 that is away from the center by a distance which is at least about three times the effective distance r1 of the effective curved surface portion 12*a*. The reason for this is that the position recognizing sections 15 does not interfere with the peripheral curved surface portion 16. In the aforementioned example, there has been shown an occasion in which the position recognizing section 15 is formed with a convex portion in a convex form. However, the position recognizing section 15 may also be formed with a concave portion having a section in a concave form, or, even with a position recognizing mark, without being limited to the convex portion. Even with the structure of this kind, the same effects as in the foregoing can be exhibited.

With regard to the peripheral curved surface portion 16, it is preferable that first radius R1 (radius of curvature) of the curved surface portion 12 is formed to be in a size ranging from about the same size as, to about 10 times the second radius R2 (radius of curvature) of the curved surface constituting the peripheral curved surface portion 16 as shown in FIG. 2(B). It is further preferable that position X3 of a boundary area between the peripheral plane surface portion 14 and the peripheral curved surface portion 16 where an inclination angle of a tangential line to second radius R2 is almost zero is formed at position r2 that is away by at least a distance which is about two times the effective distance r1 of the effective curved surface portion 12*a*. By doing this, it is possible to urge resist to flow down smoothly along the peripheral curved surface portion 16, and to obtain uniform a coating thickness on curved surface portion 12*a* within effective distance r1, which is a reason for the foregoing.

In the detailed description of this point, with regard to the relationship between effective distance (r1 in FIG. 2(B)) and a distance (r2 in FIG. 2(B)) to the point where an inclination angle of a tangential line is almost zero, when the point where an inclination angle of a tangential line to second radius R2 is almost zero is made to be the position of r2=4 mm from the rotational center of the base material 10, in the case of obtaining an effective distance of r1=2 mm on the first radius R1=4 mm, it was confirmed that a coating thickness which is almost uniform can be obtained on the area up to 2 mm from the rotational center of the base material 10. Due to this, it is possible to obtain the reason why it is preferable that position X3 of a boundary area between the peripheral plane surface portion 14 and the peripheral curved surface portion 16 is formed at position r2 that is away by at least a distance which is about two times the effective distance r1.

Though there has been shown an example wherein the peripheral curved surface portion 16 is formed on a spherical surface, in the present example, it may also be formed on all other curved surfaces representing aspheric surfaces, without being limited to the example. Or, the peripheral curved surface portion 16 may further be formed with a combination of a curved surface and a plane surface (taper), or with a plane surface, provided that equalization of coating thickness of a resist layer can be achieved.

In boundary X2 between the peripheral plane surface portion 14 and the peripheral curved surface portion 16, there is formed coating thickness correcting irregular portion 13 so that a portion of uneven coating thickness caused in that area at the prescribed speed of rotation is absorbed (details are described later).

Further, in the present example, it is preferable to make the resist representing a coating material to be of composition that makes an amount of evaporation to be less at the prescribed speed of rotation. As the composition, it is preferable to use, for example, resist whose viscosity is smaller (lower) than at least 150 (mPa·S) and to conduct spin-coating. By doing this, when the rotation is started while making resist L to flow down as shown in FIG. 1, centrifugal force and gravity acting on the resist L make the resist L to spread out to the peripheral area in the direction of arrow T so that a coating thickness may be uniform, which is a reason why the aforementioned composition is preferable.

Incidentally, it is more preferable to establish the structure wherein a correlative table showing the relationship between the speed of rotation and a coating thickness for each viscosity is stored in storage means 38 in FIG. 1, and thereby, viscosity control means 37 can control also the speed of rotation fitting the desired viscosity of the resist.

Further, owing to the peripheral curved surface portion 16 thus provided, resist L can flow down and spread smoothly on the gentle curved surface formed between curved surface portion 12 and flat portion 14, and equalization in coating thickness of resist coating on the curved surface portion 12 can be achieved. Further, owing to the peripheral plane surface portion 14 formed on the peripheral area of the curved surface portion 12, resist L is scattered from an outer circumferential portion of the peripheral plane surface portion 14, namely from the positions contoured from top portion X1 of the curved surface portion, as shown in FIG. 2(A). Thus, uniform forces (combination of resist viscosity, centrifugal force and gravity in the course of falling) facing outward are applied on a resist coating to control the coating thickness.

Furthermore, by forming the materials of the base material to be coated with resist 10 with, for example, a resin member, processing such as injection molding and cutting molding for the base material to be coated with resist 10 becomes easy, and it is possible to make it easy to supply. Namely, after the intensive studies of the inventors of the invention, it was cleared that changes by a solvent is less when the base material to be coated with resist 10 is formed with resin such as, for example, polyolefin for the solvent used for resist for an electron beam or a developing solution. In addition, it is preferable that the base material to be coated with resist 10 is formed with impurity member of a first conductive type such as, for example, n-type silicone. The reason for this is that optical coating thickness evaluation after resist coating can easily be applied.

(Characteristics of the Present Embodiment)

In this case, the base material to be coated with resist 10 having the aforementioned structure operates approximately as follows. Incidentally, in the present embodiment, there are characteristics in "r4 is less than 4 times the radius of the curved surface portion", "a coating thickness correcting irregular portion is prepared on the base material side in advance", "speed of rotation and viscosity are made to be within a prescribed range", "resist is supplied continuously in the course of preliminary spin", "correction by means of gravity control", "to correct through spin-coating by immersing in a dip tank under the condition of facing downward" and "surface roughness", and each of them will be explained in detail as follows.

(Less than 4 Times the Radius of the Curved Surface Portion)

First, the fist characteristic of the present embodiment lies in the point that distance r4 from the rotational center of curved surface portion 12 to the peripheral end of peripheral plane surface portion 14 is made to be less than about 4 times radius R1 of curved surface portion 12.

For example, it was found out that when critical point X2 representing a boundary area between curved surface portion 12 and peripheral curved surface portion 16 is made to be away from the rotational center by 3 mm, by making R1 and R2 to be respectively 4 mm, as shown in FIG. 11(A), coating thickness becomes uniform when distance r4 to the peripheral end is made to be 11 mm. Due to this, it is preferable that r$ is smaller than about 4 times R1, and conversely speaking, even if r4 is equal to or longer than R1, the size becomes greater, but more effects cannot be obtained.

Therefore, it is possible to make a base material size in a manufacturing stage to be small by making the size of the base material to be coated with resist 10 to be the minimum size necessary for uniformity of the coating thickness. Owing to this, processing of base materials does not take a long time, and a term of works can be shortened and throughput is improved. Further, cost reduction can be achieved by the reduction of an amount of members used.

Figure 6:
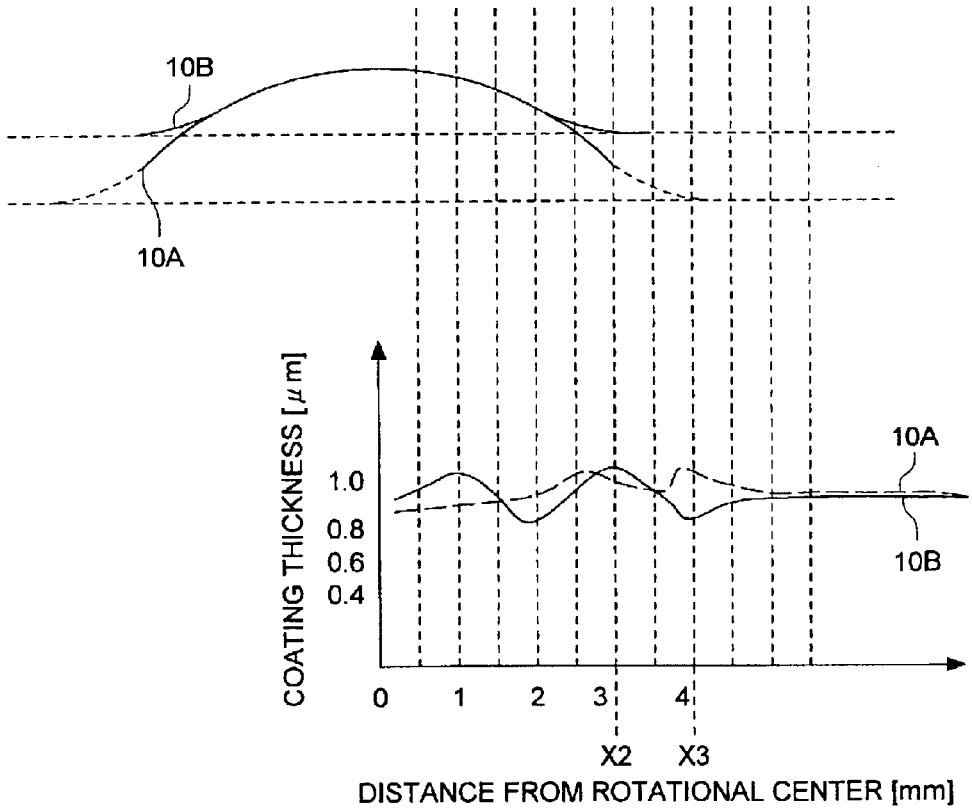
FIG. 6 is an illustration showing the relationship between a distance from the rotational center of the base material and the coating thickness, corresponding to the position of a boundary area between a peripheral curved surface portion and a peripheral plane surface portion.

Incidentally, as shown in FIG. 6, for example, it has been cleared that a coating thickness that is approximately uniform can be obtained for a range of about 2 mm from the rotational center of the base material 10, when point X3 where an inclination of a tangential line to the second radius R2 is mostly zero is made to correspond to r2=4 mm from the rotational center of the base material 10, in obtaining an effective distance of r1=2 mm at the curved surface of the first radius R1=4 mm. Namely, compared with an occasion (10B) of r2(X3), the coating thickness is more uniform in the case (10A) of r2(X3)=4.

In short, in the case (10A) of r2(X3)=4, an uneven portion of coating thickness is caused in the vicinity of critical point X2, but in other areas, a coating thickness is almost uniform. However, with respect to the uneven portion stated above, it is preferable that coating thickness correcting irregular portion 13 (offset correction) is formed by providing a shape (portion of dotted lines) that solves (absorbs) the uneven portion on critical point X2 (boundary between curved surface portion 12 and peripheral curved surface portion 16) area of the base material to be coated with resist 10 in advance. Due to this, it is possible to put an outline of "base material to be coated with resist +resist" in a prescribed shape, even when the uneven portion is formed.

(Shape of X2)

Next, more detailed structure of "coating thickness correcting irregular portion 13" will be explained. First, in FIG. 7, there is shown the relationship of the speed of rotation, a distance from the rotational center of the base material in each layer, and a resist thickness, in the case of supplying resist continuously.

For example, when the final desired coating thickness of resist is assumed to be about 1600 nm, there is assumed an occasion where final coating thickness is obtained by conducting each of resist coating and baking twice in the example shown in the drawing, and by making resist to be of a two-layer structure. In this case, when the speed of rotation is 700 rpm, the first layer has a resist thickness of about 700 nm, and the second layer has a resist thickness of about 900 nm, resulting in a final thickness of about 1600 nm.

Incidentally, on the first layer of 700 rpm, a coating thickness is almost uniform up to the distance of 2 mm from the center, while, on the area in the vicinity of critical point X2, uneven portion M1 where a coating thickness is slightly uneven is formed. Further, even on the second layer of 700 rpm, uneven portion M2 where a coating thickness is slightly uneven is formed equally in the area in the vicinity of critical point X2. This uneven portion M2 is considered to include an influence of a thickness of the uneven portion by the uneven portion M1.

In the present embodiment, therefore, coating thickness correcting irregular portion 13 is formed in advance in the area near critical point X2 of the base material to be coated with resist 10 so that a thickness by the uneven portion M1 may be absorbed. Namely, for the portion where the swelled thickness of the uneven portion M1 is great, coating thickness correcting irregular portion 13 is formed to be concave, while for the portion where the thickness of the uneven portion M1 is small, coating thickness correcting irregular portion 13 is formed to be convex, thus, a thickness of "the base material to be coated with resist 10+resist" can be made uniform.

Now, a method to determine the shape of the coating thickness correcting irregular portion 13 will be explained. In the present example, a range up to a distance of 1.8 mm from the center of the base material to be coated with resist 10 is defined as a coating thickness flat portion, because the coating thickness is mostly constant within a range up to a distance of 2 mm from the center of the base material to be coated with resist 10 as stated above, and an average value of the resist coating thickness on this coating thickness flat portion is assumed to be called a standard value. As is shown in FIG. 24, a resist coating thickness at each radial position for a plurality of, for example, 32 base materials to be coated with resist 10 wherein all layers are coated with resist is measured. Then, an amount of displacement from the standard value stated above of the resist coating thickness in each radial position is calculated. Further, as shown in FIG. 25, an average value of the displacement amount (average value of 32 base materials in the present example) is obtained, and based on this average value, there is prepared standard shape data, namely, a base line of the coating thickness correcting irregular portion 13 is prepared. Then, after this, when forming the coating thickness correcting irregular portion 13 on the base materials to be coated with resist 10, its shape is processed based on that base line. To be more concrete, in the step to process the base materials to be coated with resist 10 described later, when cutting with a diamond tool on an ultra-high precision lathe for conducting cutting work on the base materials to be coated with resist 10, an amount of its feeding and a depth of cut are determined based on the base line and the coating thickness correcting irregular portion 13 is formed.

An amount of displacement of resist coating thickness in each radial position for the plural (optional 20) base materials to be coated with resist 10 from the base line is shown in FIG. 26. In the drawing, a range of 0–2.6 mm for the radial position representing the portion corresponding to product is extracted and an amount of its coating thickness displacement is shown. In the present example, three out of the number of individuals 20 were out of ±14 (nm)/0.2 (mm) representing the controlled value. However, the rest of them representing 17 individuals were within the controlled value, resulting in the rate of accepted products of 17 individuals/20 individuals=85%.

Incidentally, the controlled value mentioned here is one defined as follows. When there is a difference between the actual shape structured by "base material to be coated with resist 10+resist" and the shape in design (ideal shape), wave front aberration including spherical aberration, for example, is caused when the base material to be coated with resist 10 is manufactured as an optical lens. Wave front aberration $\Delta W$ is preferably one fourth of wavelength $\lambda$ of incident light, as is known as Rayleigh limit, and this is expressed by the following expression;

$$\Delta W=(n-1)d\leqq\lambda/4$$

wherein, when wavelength $\lambda$ of incident light, for example, is assumed to be 400 nm and refractive index n is 1.5, allowable shape error d is as follows.

$$d\leqq\lambda/4\ (n-1)$$

$$=400\ (\text{nm})/4\ (1.5-1)$$

$$=200\ (\text{nm})$$

However, allowable shape error d needs to be determined considering the safety factor, because other error factors need to be considered actually. In particular, when a shape of a metal mold is made (see the description made later) through many steps including a transfer step, an error control value of its coating thickness distribution form was determined as ÷35 (nm)/0.5 (mm) (=±14 (nm)/0.2 (nm)).

Incidentally, a method of measuring resist coating thickness in each radial position for the base material to be coated with resist 10 is disclosed in detail by TOKUGAN No. 2002–008162 that is a prior application of the inventors of this invention, and brief explanation of its basic principle is as follows. As is shown in FIG. 27, when base board B covered by film M is irradiated by light L1 (light having a relatively wide visible band), its reflected light is split into reflected light L2 reflected on the surface of the film M and reflected light L3 reflected on the surface of the base board B. Herein, the thickness of layer M is represented by d, and its refractive index is represented by n. Light path of reflection light L3 becomes approximately 2d longer than that of reflection light L2. As a result, light interference occurs, whereby depending on layer thickness d, the peak of light intensity is generated at the specified length. Accordingly, by analyzing such reflection light upon being converted to electric signals, employing solid imaging elements and others, it is possible to obtain reflection light spectra. When, for example, an i line or a g line is employed, the formation of said peak of light intensity becomes not clear due to the fact that such lines have a somewhat broad wavelength region. Accordingly, by exposing light from a light source to base board B, which has not previously covered with layer M, its reflection ratio spectra are obtained in the same manner as above. Subsequently, based on the difference in the reflection spectra before and after the coverage of layer M, it is possible to draw a graph as shown in FIG. 28. In FIG. 28, reflection light spectra (reflection ratio spectra) are analyzed under the state shown in FIG. 27. There is the top of the wave at 582 nm and the bottoms of the wave at 548 and 622 nm. Herein, $\lambda_{2m}$ represents the wavelength at the top, while $\lambda_{2m+1}$ represents the wavelength at the bottom. Then, thickness d of layer M and refractive index n are represented by the formula described below:

$$Nd=(\lambda_{2m}\times\lambda_{2m+1})/4(\lambda_{2m}-\lambda_{2m+1})$$

Based on the above formula, when refractive index n is known, it is possible to calculate layer thickness d. Herein, however, attention should be paid for the following. In the present embodiment, the base material to be coated with resist 10, under the present measurement, is shaped so as to form a curved surface. As a result, in order to accurately measure layer thickness d of resist L, it is required that at each measurement, the incident angle of light L1 to the measuring curved surface of the base material to be coated with resist 10 is adjusted approximately to 90 degrees, namely, the emitting direction of light L1 is arranged so as to be approximately orthogonal to the measuring curved surface. Incidentally, an apparatus as well as a method to realize the foregoing is detailed in the aforesaid Japanese Patent Application No. 2002-008162.

As mentioned above, in the present embodiment, by previously forming layer thickness correcting irregular portion 13 in the area adjacent to critical point X2 of the base material to be coated with resist 10, it is possible to make the thickness of the first layer uniform at 700 rpm. As a result, it is possible to allow the thickness of the resultant coating to be approximately uniform while regulating difference in thickness of uon-uniform portions of the second and following layers within the minimum limit (within the allowable limit).

Incidentally, the aforesaid example shows that said coating thickness correcting irregular portion 13 is shaped so as to correct non-uniform portion Ml due to the characteristics of the first layer at 700 rpm. Said portion 13 may be shaped so as to correct non-uniform portion M2 due to the characteristics of the second layer at 700 rpm. The case in which the resist layer is comprised two layers has been exemplified. However, the present embodiment is not limited to this, but includes a single layer as well as at least two layers.

In such cases, when the coating thickness correcting irregular portion 13 is shaped so as to correct a characteristic shape, depending on said characteristic shape of a non-uniform portion due to characteristics of the nth layer, it is more preferable that the effects of the non-uniform portion of each layer forming a multilayer are removed whereby finally, it is possible to assuredly achieve almost uniform coating thickness.

The case at 700 rpm has been described. However, a case is also acceptable in which coating thickness correcting irregular portion 13 is shaped so as to match the characteristics of another specified speed of rotation. In such a case, for example, a second layer at 2,000 rpm exhibits marked a non-uniform portion. Then, it is preferable that said portion 13 is shaped so at to match the non-uniform portion of the second layer. Further, when reaching 4,000 rpm, a non-uniform portion is not noticed. In such a case, it is unnecessary to prepare coating thickness correcting irregular portion 13 and said portion 13 may be suitably formed while appropriately varied depending on the speed of rotation.

Incidentally, the shape of the aforementioned non-uniform portion exhibits to some extent reproducibility depending on each speed of rotation. The shape of said coating thickness irregular portion 13 may be formed depending on the standard shape which is obtained as the addition average of each of non-uniform portions at the characteristic of each speed of rotation.

As mentioned above, by previously forming said coating thickness correcting irregular portion 13 for the base material to be coated with resist 10, it is possible to allow the surface of the final resist layer to be uniform.

(Viscosity and Speed of Rotation)

The setting range of viscosity as well as speed of rotation will now be described. Herein, before describing the relationship between the speed of rotation or viscosity and the coating thickness, the mechanism of common spin coating will now be described.

Figure 9:
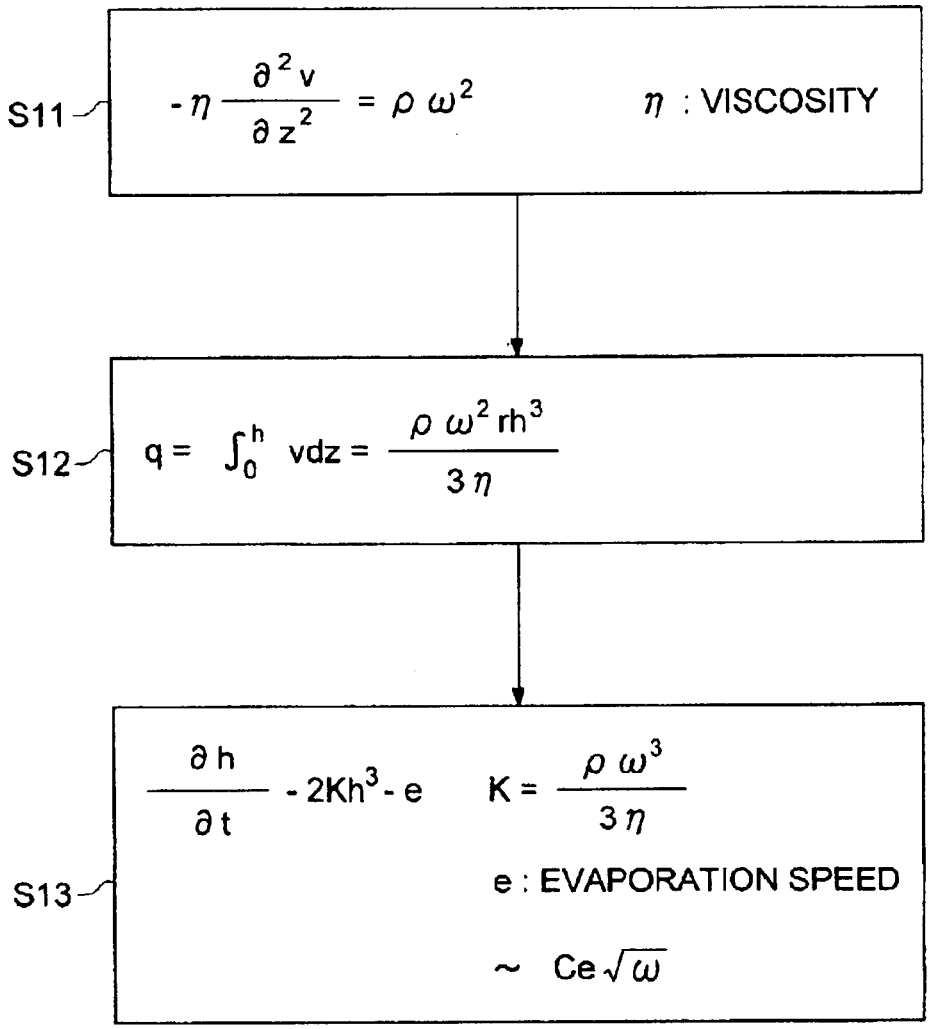
FIG. 9 is an illustration showing the relational expression for illustrating the mechanism of spin-coating on the plane surface.

First, when base material to be coated with resist 10 is shaped to be a plane board, S11 in FIG. 9 is obtained as a relational formula, expressing the spread of a solution (a resist solution) due to centrifugal force to the peripheral direction. Based on said formula, resist coating amount (a flow amount) q is expressed by S12 in FIG. 9. Further, the resist coating thickness per unit time is obtained by S12 in FIG. 9. Herein, in each formula, as shown in FIG. 8(A), $\omega$ represents the rotational angular velocity during spin coating (during rotary coating), h represents the thickness of the resist, r represents the radius of the resist portion, $\eta$ represents the viscosity of the resist, z represents the minute thickness, q represents the resist coating amount, and e represent the evaporation rate.

On the other hand, when base material to be coated with resist 10 is shaped to exhibit a curved surface, S21 in FIG. 10 is obtained as a relational formula, expressing the spread of a solution (a resist solution) due to centrifugal force to the peripheral direction. Based on said formula, resist coating amount (a flow amount) q is expressed by S22 in FIG. 10. Herein, as shown in FIG. 8(B), $\Theta$ represents the radial angle on the curved surface.

Based on these formulas, for example, based on S22 shown in FIG. 10, it is possible to theoretically set the relationship of coating thickness h at the specified position on the curved surface at specified viscosity $\eta$ and angular velocity $\omega$. However, this is valid only for the curved surface portion of the present embodiment, and effects of the peripheral curved surface portion as well as the peripheral plane surface portion is not included.

Under the aforesaid premise, the speed of rotation as well as the position of critical point X2 will now be investigated which allow the coating thickness to be uniform in the base material to be coated with the resist, having a curved surface portion, a peripheral curved surface portion and a peripheral plane surface portion as shown in the present embodiments.

Figure 11:
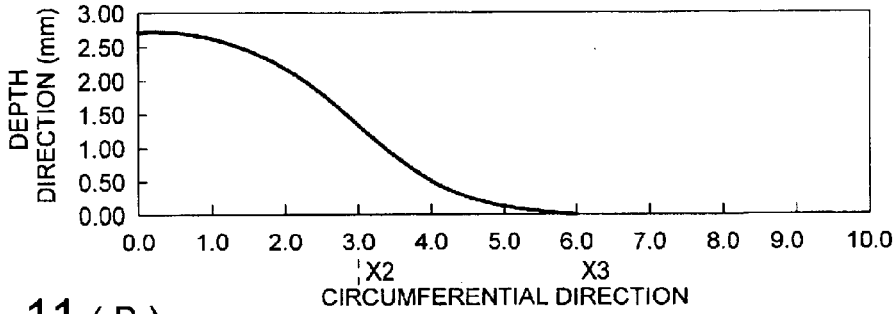
FIGS. 11(A)–11(D) show illustrations for explaining the relationship of a distance from the rotational center, gravity applied on resist and centrifugal force.
Figure 11:
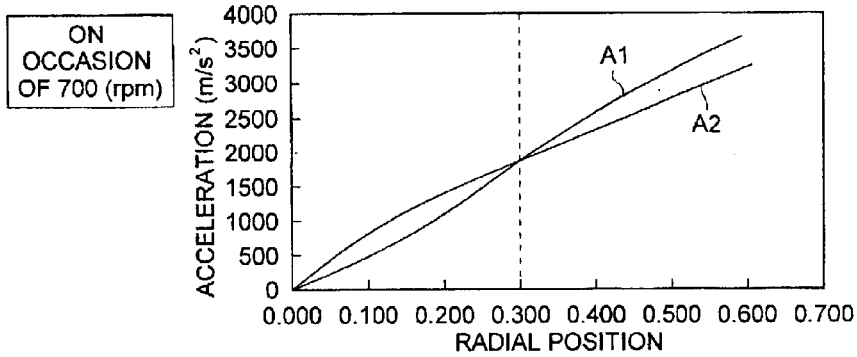
Figure 11:
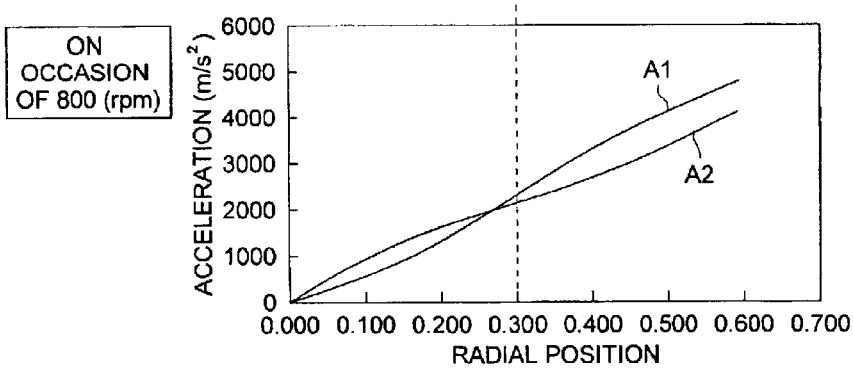
Figure 11:
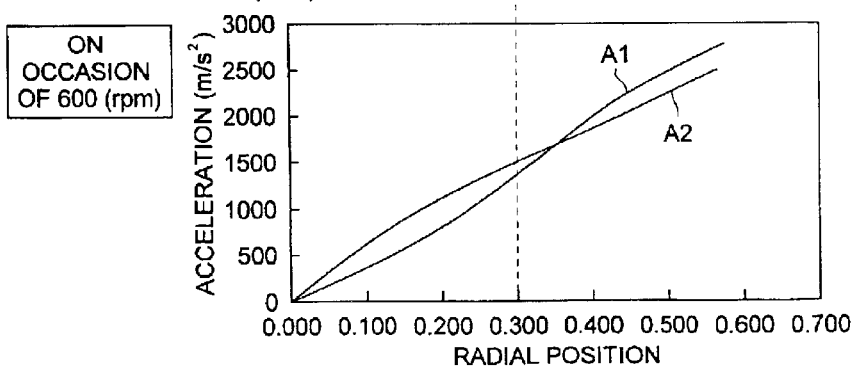

For example, as shown in FIG. 11(A), when R1 and R2 are made to be 4 mm and when critical point X2 representing a boundary area between curved surface portion 12 and peripheral curved surface portion 16 is made to be away from the rotational center by 3 mm, the relationship between gravity and centrifugal force both acted on resist solutions on the curved surface portion 12 is as follows, as shown in FIG. 11(B). Namely, when the speed of rotation is 700 rpm, centrifugal force A1 is balanced with gravity A2 on critical point X2, but when the speed of rotation is 800 rpm (FIG. 11(C)), the position where centrifugal force Al is balanced with gravity A2 becomes a radial position that is closer to the rotational center axis, and on the contrary, when the speed of rotation is 600 rpm (FIG. 11(*d*)), the position where centrifugal force A1 is balanced with gravity A2 becomes a radial position that is closer to the outer peripheral portion than critical point X2.

Namely, when the speed of rotation is around 700 rpm, centrifugal force and gravity are in the tendency to be balanced at critical point X2, but when the speed of rotation is increased to 1000 rpm or 2000 rpm, a term of $r\omega$ becomes great and centrifugal force becomes great, and both gravity and centrifugal force become great at the position that is closer to the rotational center axis, thus, gravity is not balanced with centrifugal force at critical point X2.

Therefore, in the established example shown in FIG. 11(A), it is preferable to make the speed of rotation to be about 700 rpm because critical point X2 becomes a position of balance.

By doing the foregoing, it is also possible to control a coating thickness by changing viscosity of a resist solution by selecting the position of the critical point X2 and the speed of rotation.

In this case, even when the aforementioned conditions are satisfied, there is caused an uneven portion of coating thickness in the area near the critical point X2. However, this uneven portion of coating thickness cab be solved by the coating thickness correcting irregular portion.

What is important in this case is that uniformity of coating thickness was achieved at the speed of rotation of about 700 rpm at the area other than critical point X2, although an uneven portion of coating thickness was caused at critical point X2. Therefore, it is possible to achieve uniformity of a coating thickness by combining the selection of the speed of rotation and the coating thickness correcting irregular portion.

Next, as a comparative example, there is assumed that resist is coated in a way similar to continuous flowing down. For example, as shown in FIG. 12(A), aging change of a coating thickness in the period of time 0–135 sec. under the condition that the speed of rotation is 700 rpm and viscosity is one for which an amount of evaporation at the aforesaid speed of rotation is not remarkable, for example, 66–276 cp, is shown as H0–H12 in the drawing, but the coating thickness becomes uniform with the lapse of time. The coating thickness naturally becomes flat in a certain period of time because a resist solution flows.

On the other hand, as shown in FIG. 12(B), aging change of a coating thickness in the period of time 0–9 sec. under the condition that the speed of rotation is 2000 rpm and viscosity is one for which an amount of evaporation at the aforesaid speed of rotation is not remarkable, for example, 100–400 cp, is shown as H0–H12 in the drawing, and in any cases, an uneven portion of coating thickness is caused at the area near the critical point.

As a result, the foregoing implies that the speed of rotation 2000 rpm that is especially high is not preferable, and the speed of rotation of about 700 rpm is inevitably preferable from the viewpoint of coating thickness uniformity.

Further, the viscosity of about 66–276 cp is preferable, and viscosity of 150 (mPa·S) or less is further preferable.

As stated above, it is possible to obtain the desired coating thickness that is mostly uniform, by repeating the process for spin-coating a resist solution having viscosity of about 150 (mPa·S) or less at about 700 (rpm) so that gravity and centrifugal force both acting on resist on the curved surface may be balanced, and the process of baking.

(Merit of Continuous Supply)

For example, as a comparative example, there is assumed a method of spin coat wherein the surface of a base material to be coated with resist is covered by a resist solution by pouring down it for term T0, then, pre-spin is conducted by rotating the base material to be coated at the prescribed speed of rotation (for example, 200 rpm) for term T2, and after that, regular spin is conducted at the prescribed speed of rotation (for example, 1500–400 rpm) for term T4, as shown in FIG. 20(A). In this case, as shown in FIGS. 20(B) and 20(C), a tendency of monotone increase of coating thickness is remarkable on the area closer than a critical point to the rotational center axis in any case of the speed of rotation 700 rpm and the viscosity 100 cp, the speed of rotation 2000 rpm and the viscosity 100 cp, the speed of rotation 4000 rpm and the viscosity 100 cp, the speed of rotation 2000 rpm and the viscosity 300 cp and the speed of rotation 4000 rpm and the viscosity 300 cp.

Figure 16:
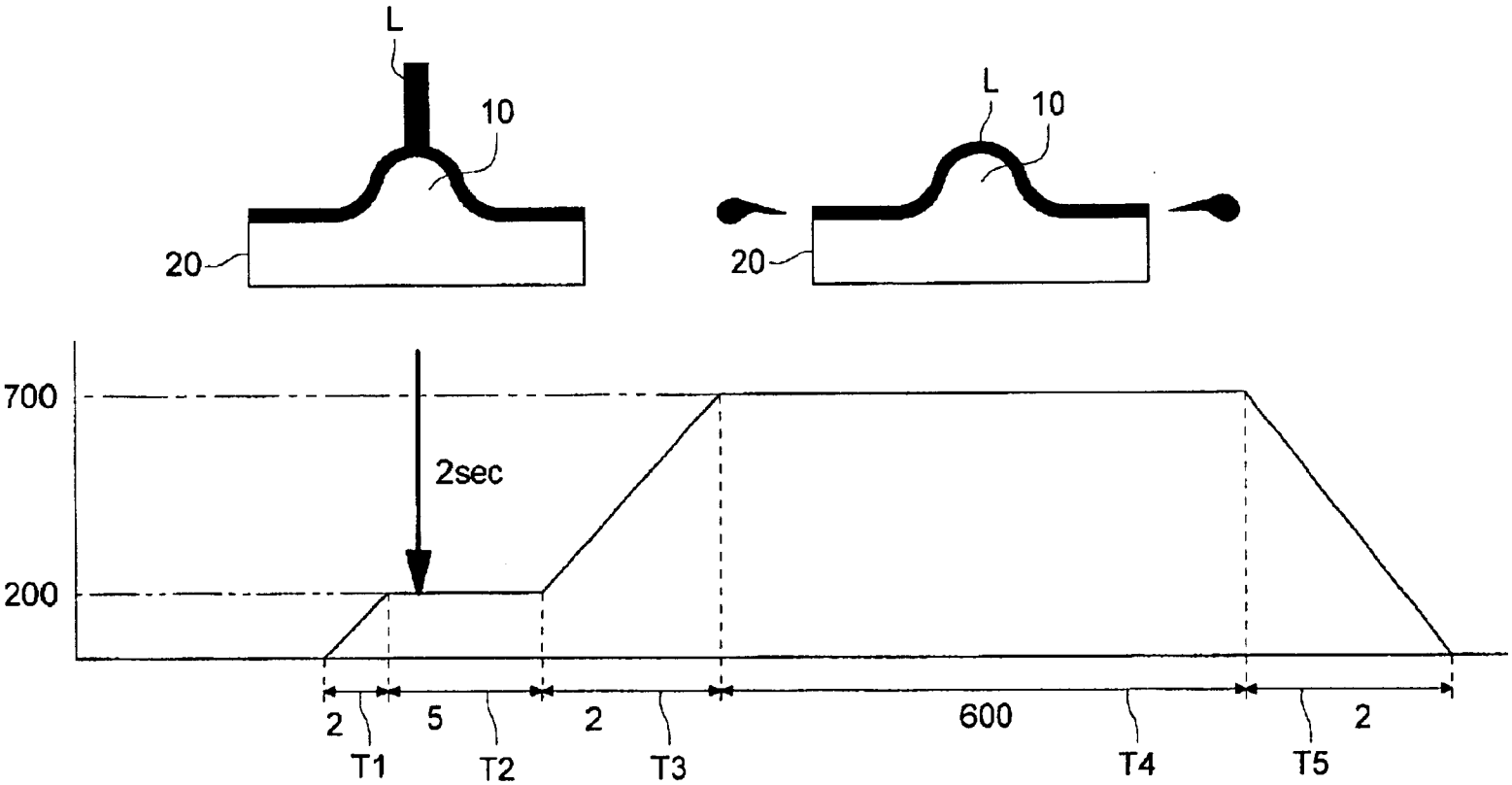
FIG. 16 is an illustration for explaining aging changes of the speed of rotation in the case of continuous supply of resist in the course of preliminary spinning.

In the present embodiment, on the contrary, a resist solution is supplied continuously in the course of preliminary spin. To be concrete, for example, as shown in FIG. 16, the speed of rotation is increased during the term T1 (for example, 2 sec.) first, and during the term T2 (for example, 5 sec.), resist solution L is supplied continuously for the constant supply during the preliminary spin in which the base material to be coated with resist 10 is rotated at the first speed of rotation (for example, 200 rpm).

Due to this, a resist solution is supplied continuously to the coating thickness that is in a tendency to become thin at the top portion area of curved surface portion 12 because of gravity and centrifugal force, at the speed higher than that for the coating thickness to become thin (corresponding to the amount of resist solution that cannot stay at the top portion because of force), resulting in replenishment of the amount of resist solution corresponding to the thinner coating thickness, and a uniform coating thickness can be obtained on the curved surface portion.

After that, supply of a resist solution is stopped, the speed of rotation is increased in the term T3 (for example, 2 sec.) and regular spin is conducted in the term T4 (for example, 600 sec.) to finish spin coat in the term T5 (for example, 2 sec.).

Incidentally, when supplying resist solution L continuously, the supply is started for an injector constituting coating material coating means 31 simultaneously with trigger from coating material supply time control means 34, using air pressure, and this is realized by controlling air pressure of a dispenser in accordance with the speed of rotation. Incidentally, it is preferable that the coating material coating means 31 is provided with a fluctuation prevention means that lowers an influence of fluctuation in the course of continuous supply.

By supplying continuously a resist solution for the rotational center axis of the base material to be coated with resist in the course of preliminary spin as stated above, it is possible to compensate the reduction of resist solution on the rotational center axis caused by rotation, and thereby, monotone increase of coating thickness distribution for an area from the rotational center axis to a peripheral portion of the base material to be coated with resist has been eliminated.

(Correction by Gravity Control)

Figure 17:
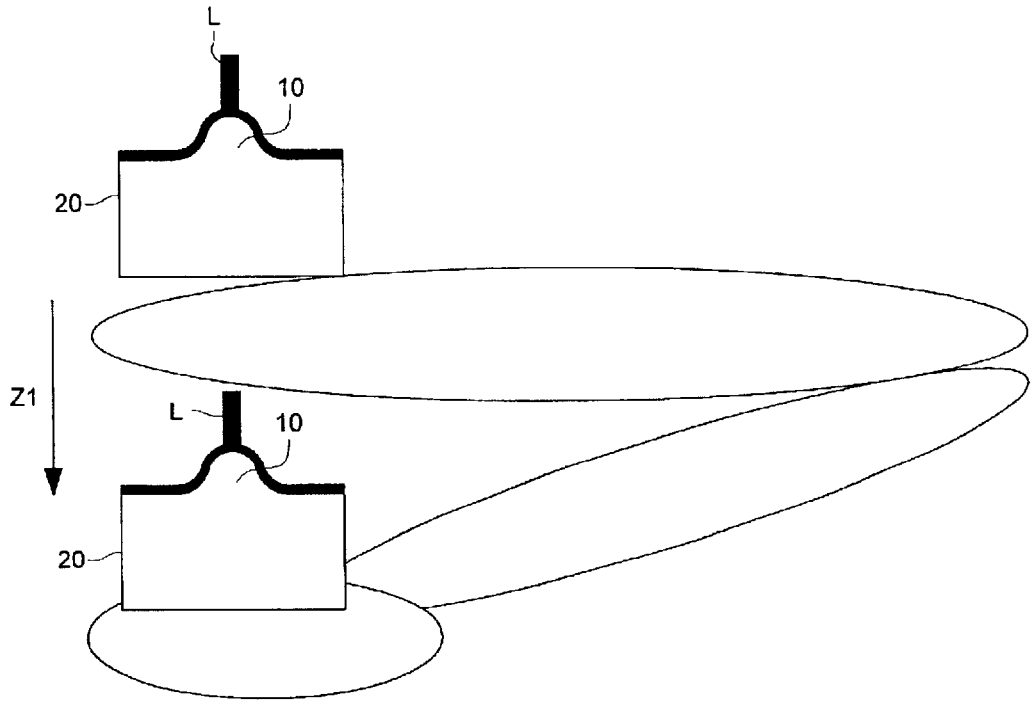
FIG. 17 is an illustration showing how a spin coater chuck is lowered.

Further, in the present embodiment, when spin coater chuck 20 on which the base material to be coated with resist 10 is fixed is moved downward (Z1 direction) vertically at the prescribed acceleration by the gravity control means 43 as shown in FIG. 17, in the course of regular spin or preliminary spin, an influence of gravity acted on a resist solution on curved surface 12 is lowered.

Namely, since the force acting downward is applied on a resist solution on curved surface portion 12 in the case of rotation, the force acting upward that cancels the force acting downward is generated when moving downward by gravity control means 43 for the period of rotation, and as a result, an influence of gravity applied on the resist solution in the case of rotation can be removed. In particular, if it is operated downward only for the period for resist solution L to finish flowing down along the slope on the curved surface portion 12, its effect becomes conspicuous.

By moving downward in the vertical direction in the case of rotation as stated above, it is possible to lower an influence of gravity acted on a resist solution on the curved surface portion, and to contribute to uniformity of coating thickness distribution of a resist film.

(Correction by Dipping in Dip Tank)

Figure 7:
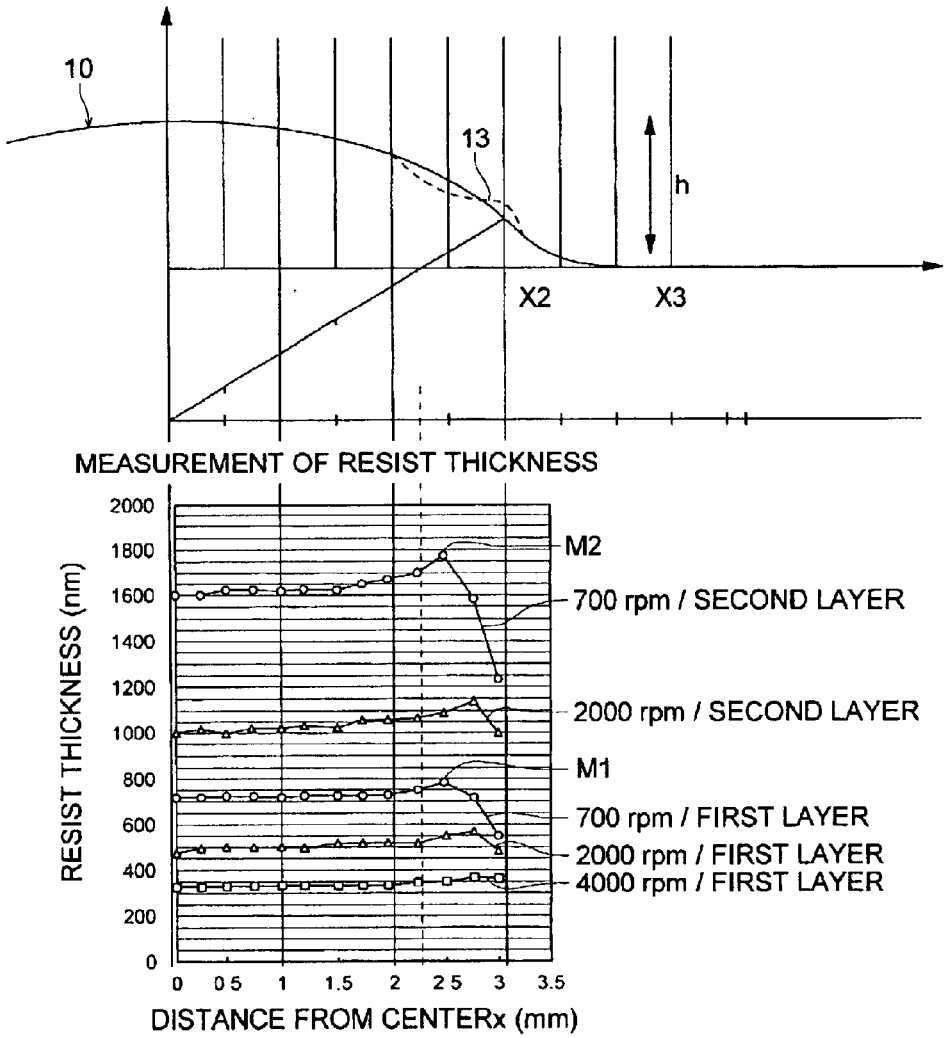
FIG. 7 is an illustration showing the relationship between a distance from the rotational center of the base material and a thickness of resist, in the case of continuous supply of resist in the course of preliminary spin.

Next, another method to solve an uneven portion of coating thickness that is shown in FIG. 7 and explained in the term "Shape of X2".

Figure 19:
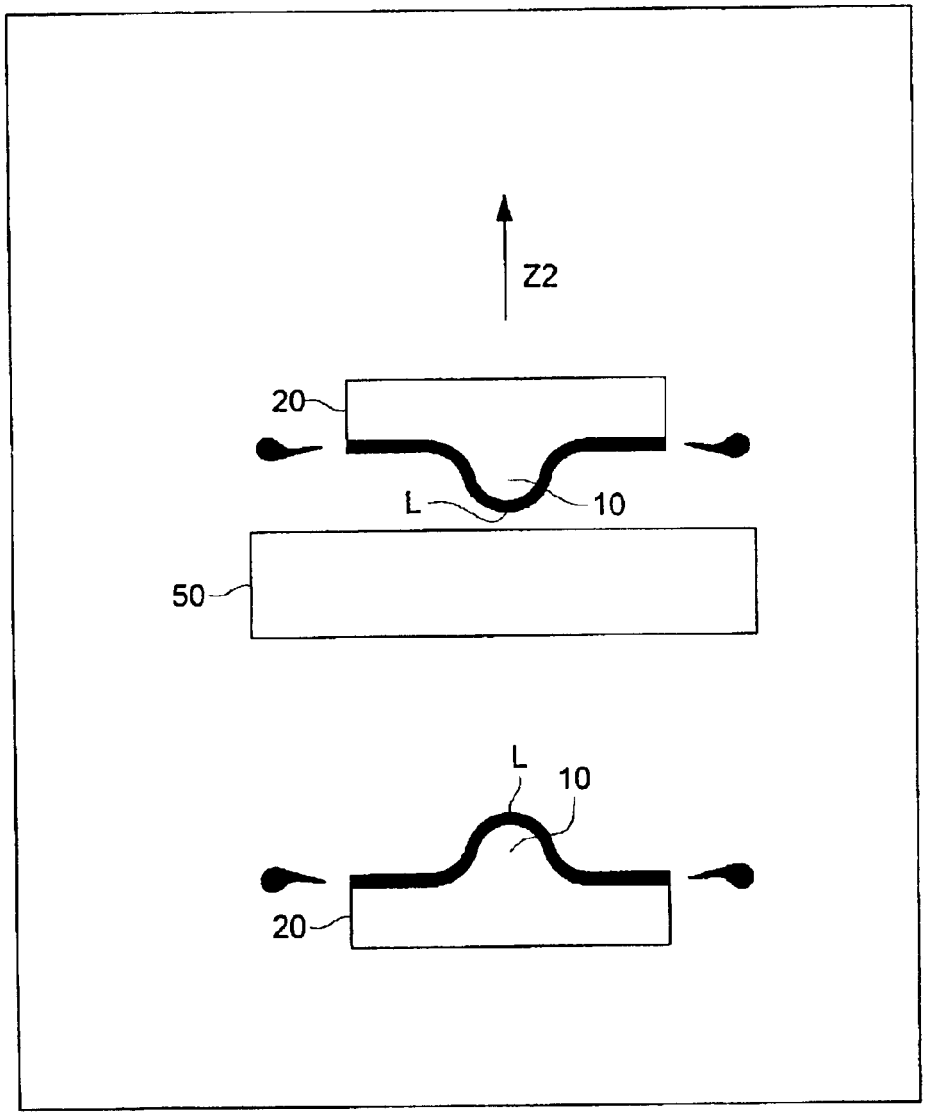
FIG. 19 is an illustration for explaining the outline of the processing in the case of immersing in a dip tank.

In the detailed description, base material to be coated with resist 10 is immersed in dip tank 50 with its top portion facing downward, as shown in FIG. 19. Next, the base material to be coated with resist 10 is lifted while it is rotated, and the first layer is formed thereon to be baked.

In FIG. 7 in this case, when resist was supplied continuously while rotating upward at 700 rpm, a rate of influence of gravity was changed at an area near critical point X2, and uneven portion M1 was formed. On the contrary, when rotating downward at the prescribed speed of rotation (700 rpm), the coating thickness in a shape opposite to that of the aforesaid uneven portion (namely, a concave shape in this downward rotation, if the shape in FIG. 7 is convex) was to be formed. Therefore, on at least the first layer, an inverse uneven portion in a concave shape is formed.

Then, under the condition that the inverse uneven portion is formed, the top portion of the base material to be coated with resist 10 is turned to face upward (initial state) again as shown in FIG. 19, and there is conducted preliminary spin for spin-coating by supplying resist solution L continuously to the rotational center which is followed by regular spin and baking, thus, the second layer is formed.

In this case, when the second layer is formed, an uneven portion in an area near the critical point X2 is formed by the formation of the second layer, but a shape of the uneven portion of the second layer is opposite to the shape of the uneven portion of the first layer, and ununiformity on the whole is canceled. owing to this, uniform coating thickness can be obtained independently of the critical point.

By dipping the base material to be coated with resist in a dip tank with its top portion facing downward and by lifting it while it is rotated, to form the first layer, and by turning the top portion of the base material to be coated with resist so that it may face upward, and by supplying resist solution to the rotational center portion continuously to conduct spin-coating and to conduct baking, it is possible to obtain uniform coating thickness by canceling an influence of gravity for each coating. Incidentally, although the base material to be coated with resist is lifted up while it is rotated in the above embodiment, it is possible to rotate the base material after the base material is lifted up.

Incidentally, though there has been explained an occasion wherein a resist film is structured with two layers in the present embodiment, it is also possible to structure the resist film with n layers. However, when structuring with n layers, if n is an even number, it is preferable to structure so that an odd numbered layer is mad to face downward and the even numbered layer is made to face upward. Further, if n is an even number, it is also possible to structure so that the first layer to the $(n/_2)^{th}$ layer are made continuously to face downward and the $(n/2+1)^{th}$ layer and thereafter are made to face upward. Incidentally, the order of facing downward and facing upward may be opposite.

When $n(n\neq1)$ is an odd number, it is also possible to structure so that the first layer to the $k(2\leqq k\leqq n-1)^{th}$ layer are made to face downward and $(k+1)^{th}$ layer and thereafter are made to face upward. However, it is necessary use a method to control and adjust the number of rotation so that the total of inverse uneven portions up to the $k^{th}$ layer and the total of uneven portions of the $(k+1)^{th}$ layer and thereafter may cancel each other. In such a case, it is preferable to store in the storage means 37 a table wherein a shape of the coating thickness of uneven portion corresponding to each speed of rotation and critical point position X2 are defined in advance, for the control.

(Surface Roughness)

Next, the surface roughness used for processing the base material to be coated with resist in the present embodiment will be explained. First, a schematic structure of an ultra-high precision lathe for processing base material to be coated with resist 10, for example, a schematic structure of SPDT (Single Point Diamond Turning) will be explained as follows, referring to FIG. 13 and FIG. 14.

Figure 13:
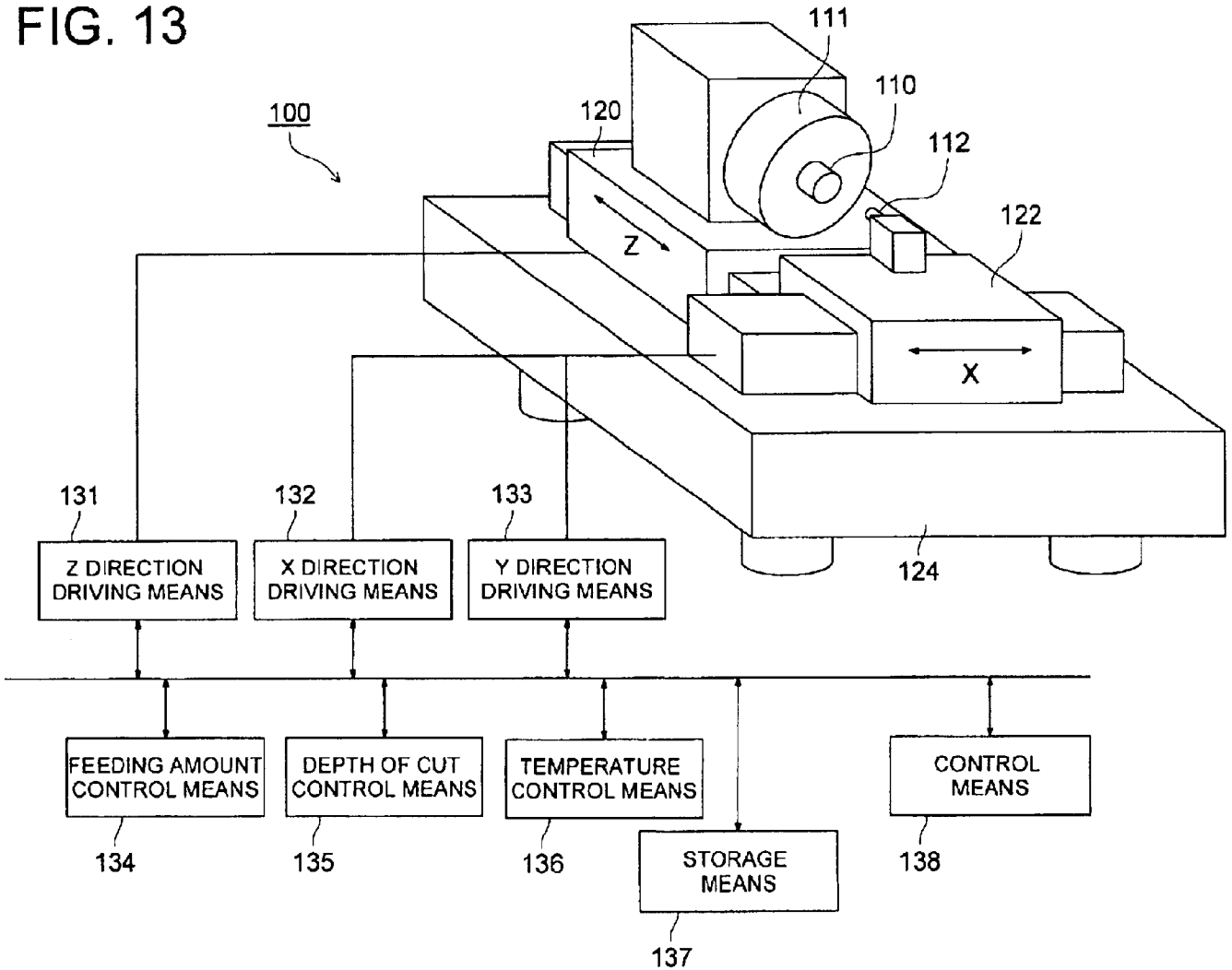
FIG. 13 is a functional block diagram showing an example of the structure of an ultra-high precision lathe used for processing of a base material.

As shown in FIG. 13, the ultra-high precision lathe 100 is composed of fixing portion 111 for fixing work 110 such as the base material to be coated with resist, diamond tool 112 representing a cutting tool edge for turning the work 110, Z-axis sliding table 120 that moves the fixing portion 111 in the Z-axis direction, X-axis sliding table 122 that moves the diamond tool 112 in the X-axis (or Y-axis direction in addition) while holding the diamond tool 112, and a surface plate 124 that moves and holds the Z-axis sliding table 120 and the X-axis sliding table 122 freely. Incidentally, there is provided an unillustrated rotation driving means that drives either one of the fixing portion 111 and the diamond tool 112 or both of them, and it is connected to a control means 138 which will be explained later.

As shown in FIG. 13, the ultra-high precision lathe 100 is composed of a Z-direction driving means 131 that controls driving of the Z-direction sliding table 120, a X-direction driving means 132 and a Y-direction driving means 133 which control driving of X-axis direction of X-direction sliding table 122 (or driving in Y-axis direction in addition), a feeding amount control means 134 that control a feeding amount by the foregoing, a cutting depth control means 135 that controls an amount of cutting, a temperature control means 136 that controls a temperature, a storage means 137 that stores various control conditions, control tables and processing programs, and a control means 138 that controls each section.

Figure 14:
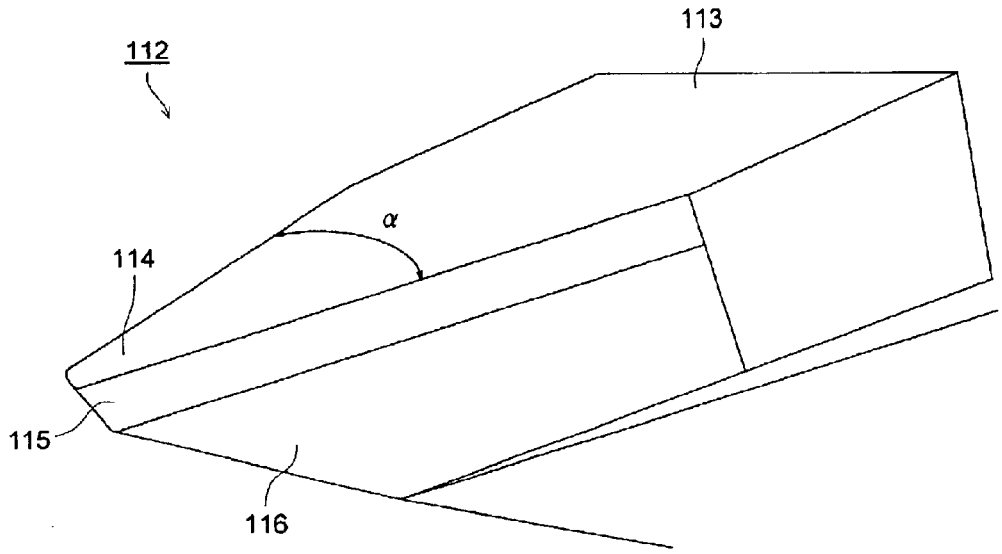
FIG. 14 is a perspective view showing an example of a tip of a cutting edge of a diamond tool used in the ultra-high precision lathe in FIG. 13.

As shown in FIG. 14, diamond tool 112 is composed of diamond tip 113, a cutting surface 114 composed of an apex angle a formed on the tip portion, the first flank 115 constituting the side portion and the second flank 116.

In the ultra-high precision lathe 100 having the aforementioned structure, operations are conducted roughly as follows. Namely, diamond tool 112 moves relatively against the work 110 that is set, and thus, the work 110 is processed. In this case, since the diamond tool 112 has the structure of a rounded tool tip as shown in FIG. 14, and therefore, the point, the tool tip touches is changed in succession and the diamond tool 112 has a resistance against wear.

In the present embodiment, when processing the base material to be coated with resist 10 by using the ultra-high precision lathe as stated above, a feeding amount and a depth of cut are controlled while temperature is controlled for cutting processing, so that the surface roughness of the curved surface may become, for example, 50 nm or less, and more preferably, 20 nm or less.

After that, tool marks which look like rainbow colors visually (structural color caused by diffraction) are ground until the rainbow (structural color) disappear.

Incidentally, in this case, "surface roughness" is defined as follows in FIG. 22(B). Namely, a certain surface is defined as a roughness curve f(y), and from this roughness curve f(y), the portion in measurement length 1 in the direction of the center line is sampled, then, when the roughness curve is expressed by x=f(y) with X axis representing the center line of the sampled portion and Y axis representing the direction of longitudinal magnification, Ra obtained by the expression in FIG. 22(B) is the surface roughness.

In this case, when base material to be coated with resist 10 is a lens, the surface roughness of the optical surface needs to be, for example, 20 nm or less. However, this does not apply to the occasion where base material to be coated with resist 10 is not a lens, the surface roughness may be 75 nm or less in which a difference of coating thickness distribution is observed. Therefore, the surface roughness is made to be about 75 nm or less, and to be about 20 nm or less more preferably.

As stated above, in the present embodiment, the surface roughness such as tool marks can be removed, and therefore, optical evaluation in the case of measuring a coating thickness is not interrupted. In addition, it has become possible to feed back all of the measurement results to the study of the resist coating method.

(Processing Procedures)

Next, when coating resist on the base material to be coated with resist having the structure mentioned above, processing steps representing the premise, and further, the first processing procedure and the second processing procedure in the case of resist coating will be explained in detail as follow.

(Processing Step)

First, in the case of cutting processing of the base material to be coated with resist, an ultra-high precision lathe, for example, SPDT (Single Point Diamond Turning) is used for diamond cutting to obtain the surface roughness of 50 (nm) or 20 nm by controlling a feeding amount and a depth of cut while controlling temperature (cutting step). After that, tool marks which look like rainbow colors visually are ground until the rainbow disappear (grinding step). Thus, after completion of processing of the base material to be coated with resist, resist coating is conducted.

(Resist Coating Step)

(First Processing Procedure)

Figure 15:
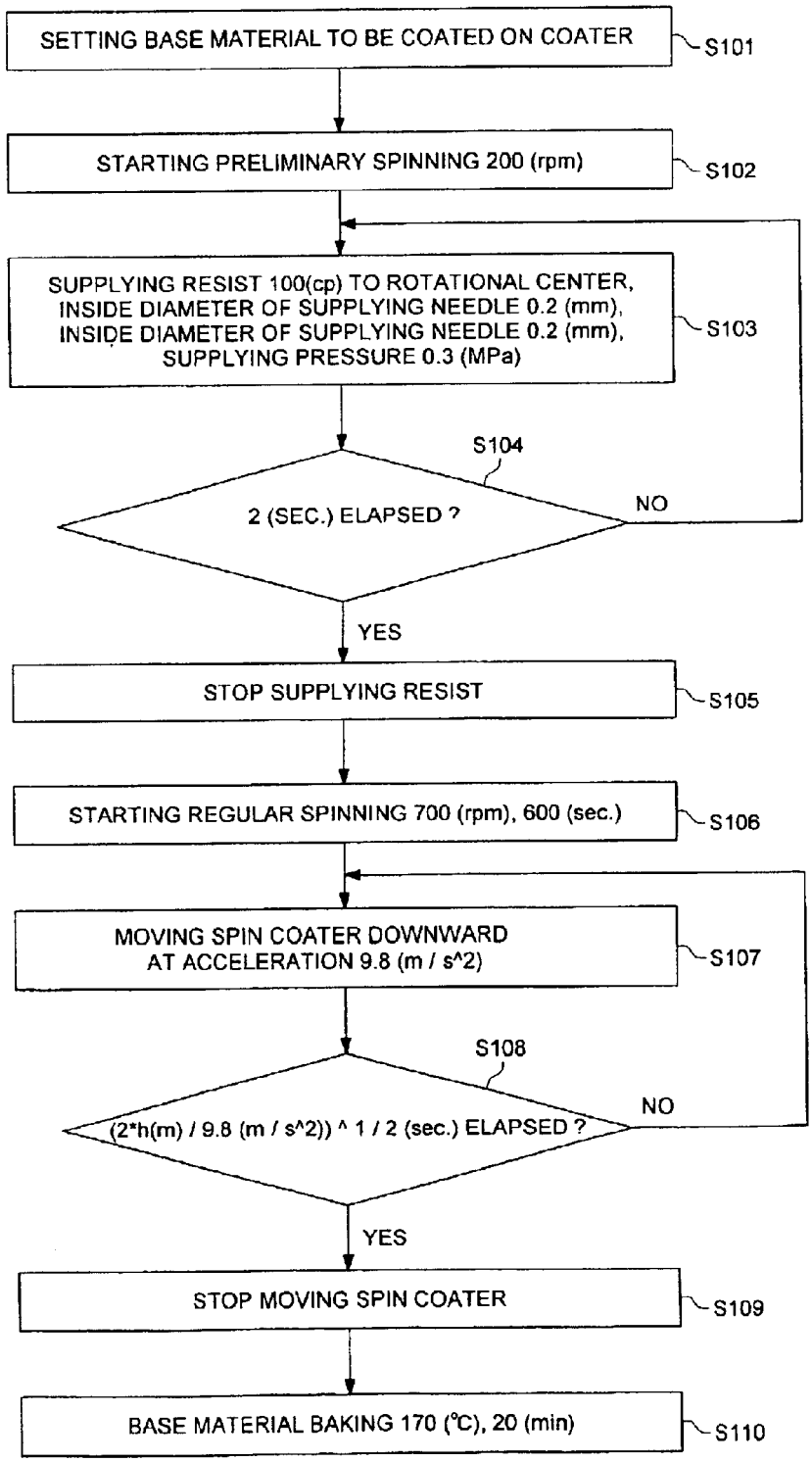
FIG. 15 is a flow chart showing an example of processing procedures for the coating processing of coating materials which are processed in the apparatus of coating a coating material of the invention.

Next, a coating step to coat resist on the base material to be coated with resist having the above-mentioned structure will be explained together with an action of the base material to be coated with resist, as follows, referring to FIG. 15–FIG. 17.

The base material to be coated with resist 10 conveyed by an unillustrated conveyance means is placed on spin coater chuck 20 to be set (step, "S" 101 hereafter). In this case, the base material to be coated with resist 10 is held and fixed naturally when it is inserted in a concave portion, because the concave portion is formed in the spin coater chuck 20. Then, alignment of the spin coater chuck 20 is conducted by driving means 30 at the prescribed position for resist to drop.

Next, the speed of rotation is raised up to the prescribed first speed of rotation (for example, 200 rpm) by speed of rotation control means 36 by utilizing term T1, then, the spin coater chuck 20 is rotated to the θ direction by θ direction driving means 35, and preliminary spinning is started during term T2 (S 102).

Then, under the state that the base material to be coated with resist 10 is rotated, resist solution L in the prescribed amount is made by coating material coating means 31 to flow down to be supplied (S 103). In this case, various controlling conditions including an amount of resist coating corresponding to the speed of rotation of the spin coater chuck 20 that makes the coating thickness to be uniform and ambient conditions, are controlled by coating amount control means 33, speed of rotation control means 36 and control means 49. For example, in the present embodiment, when an inside diameter of a supply needle of the coating material coating means 31 is made to be 0.2 mm for resist 100 cp, the supply pressure is about 0.3 MPa for example.

In this preliminary spinning, the resist flows down continuously to the top portion of the curved surface portion 12 of the base material to be coated with resist 10, and with rotation of the base material to be coated with resist 10 at the first speed of rotation, the resist that flowed down to the top portion flows down smoothly while advancing to the curved surface portion 12, peripheral curved surface portion 16 and peripheral plane surface portion 14 on the peripheral portion while keeping the coating thickness that is mostly uniform, thus, the resist is coated (spin coating step).

During this term, when rotation is made at the prescribed speed of rotation while the resist is supplied continuously, resist L spreads from the curved surface 12 to the peripheral plane surface portion 14 through peripheral curved surface portion 16.

In this case, as shown in FIG. 3, when resist spreads from X1 to X2 on the curved surface portion 12, the resist (L shown in FIG. 2) spreads along the curved surface of the curved surface portion 12, and after the resist arrives at the peripheral curved surface portion 16, it spreads at the speed that is the same as or higher than the speed at which the resist spreads on the curved surface portion 12. Due to this, the continuous surface of the peripheral curved surface portion 16 makes the resist to spread smoothly compared with the occasion wherein the coating thickness becomes uneven because of the reduction of speed caused by the shock when resist hits the peripheral plane surface portion 14 when the curved surface portion 12 and the peripheral plane surface portion 14 form a discontinuous plane.

Further in this case, an area where the coating thickness is uneven is considered to be generated on the peripheral curved surface portion 16 at its boundary area, although the coating thickness is uniform on the curved surface portion 12 and the peripheral plane surface portion 14, but, this ununiformity is solved by coating thickness correcting irregular portion 13 that is formed.

Next, determination processing to check whether a period of 2 sec. has elapsed in term T3 or not (S 104). When it is not determined that the period of 2 sec has elapsed, in this determination processing, the flow returns to S 103. On the other hand, when it is determined that the period of 2 sec has elapsed, in the determination processing in S 104, coating material supply time control means 34 gives an instruction to coating material coating means 31 to stop the supply of resist, thus, the supplying of resist is stopped (S 105).

Next, after raising the speed of rotation up to the second speed of rotation (for example, 700 rpm) that is higher than the first speed of rotation by the use of speed rotation control means 36 in term T3, regular spinning is started in term T4 (S 106).

In this regular spinning, continuous supply of resist is stopped, and the base material to be coated with resist 10 on which the resist has been coated is rotated at the second speed of rotation that is higher than the first speed of rotation (spin processing).

Then, in this case, the spin coater chuck 20 is moved to face downward by Z-direction driving means 41 (S 107). In this case, for the aforesaid moving, gravity control means 43 controls to move at the acceleration, for example, 9.8(m/(sec$^2$)). Due to this, an influence of gravity acting on resist can be removed.

Next, determination processing to check whether the period of time of $(2*h(m)/9.8(m/(sec^2)))^{(1/2)}$ (sec.) has elapsed or not (S 108). In this determination processing, when it is determined that the aforesaid period of time has not elapsed, the flow returns to S 107. On the other hand, when it is determined that the aforesaid period of time has elapsed, in the determination processing in S 108, Z-direction driving means 41 stops the moving of the coater chuck 20 downward (S 109).

Then, baking (heating) processing is conducted for the base material to be coated with resist 10 (S 110). In this case, the base material to be coated with resist 10 is heated for about 20 min. at the temperature of about 170° C.

When following this processing procedure as stated above, upward force that cancels the downward force is generated when moving downward by gravity control means 43 only for the period to rotate, because the downward force is applied on the resist solution on the curved surface in the case of rotation, resulting in removal of an influence of gravity applied on the resist solution during the rotation. In particular, the aforesaid effect is remarkable when operating downward only during the period for the resist solution L to finish flowing along the slope of the curved surface portion 12. Therefore, by moving downward in the vertical direction in the course of rotation, an influence of gravity applied on the resist solution on the curved surface portion can be reduced, which contributes to uniformity of coating thickness distribution of a resist film.

Figure 4:
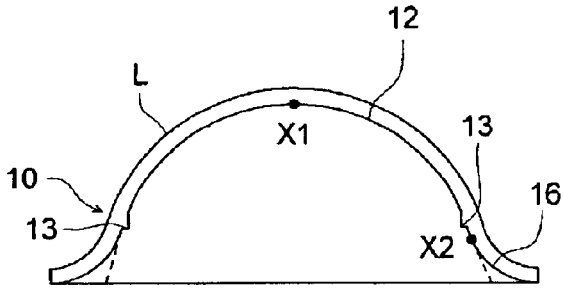
FIG. 4 is an illustration showing an example of a processing step for the base material to be coated with resist processed by the resist coating apparatus in FIG. 1.
Figure 5:
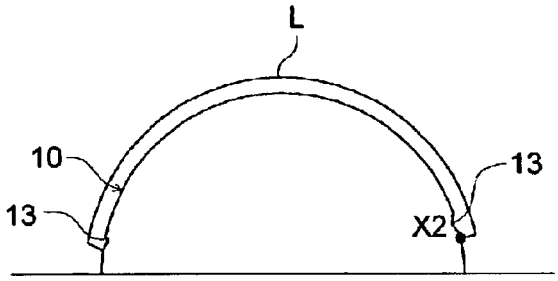
FIG. 5 is an illustration showing an example of a processing step for the base material to be coated with resist processed by the resist coating apparatus in FIG. 1.

Incidentally, in the resist coating after this, by conducting cutting processing on the peripheral plane surface portion 14 as shown in FIG. 4 and by conducting cutting processing on the peripheral curved surface portion 16 as shown in FIG. 5, it is possible to constitute the base material to be coated with resist 10 in which the resist has been coated only on the curved surface portion 14.

(Second Processing Procedure)

Figure 18:
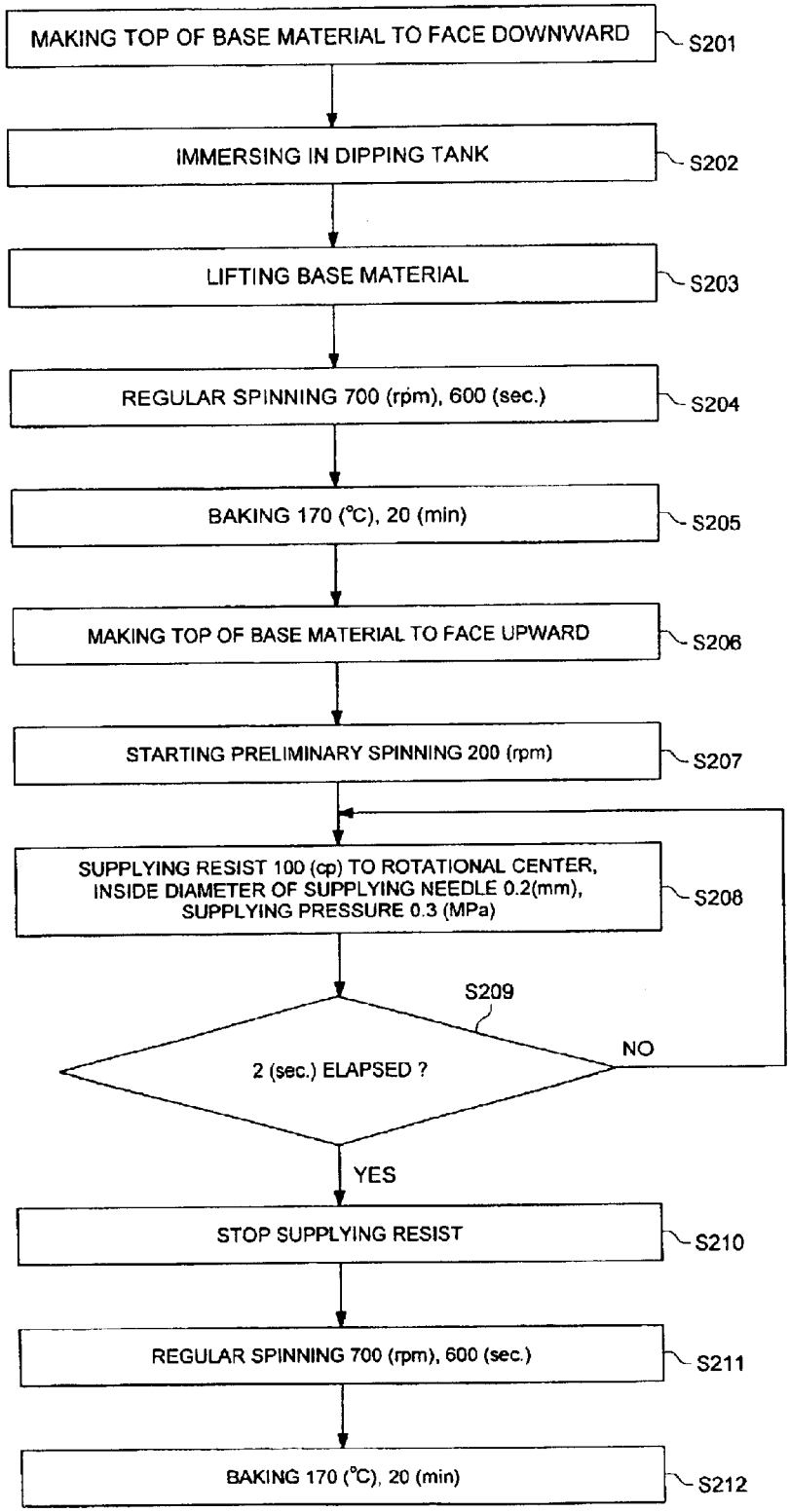
FIG. 18 is a flow chart showing an example of processing procedures of the coating processing for coating materials processed in the apparatus of coating a coating material of the invention.

Next, another processing procedure (second processing procedure) relating to resist coating will be explained as follows, referring to FIG. 18 and FIG. 19.

First, the direction of the top portion of the base material to be coated with resist 10 is changed to face downward by ψ direction spin-driving means 44*a* of upside-down reversing means 24 (S 201). In this case, as the premise, the base material to be coated with resist 10 and the spin coater chuck are fixed together by base material fixing means 47 so that the base material to be coated with resist 10 may not come off the spin coater chuck 20.

Next, by using XYZ directions moving means 44*b*, the base material to be coated with resist 10 held by the spin coater chuck 20 to face downward is dipped in dip tank 50 (S 202). Then, after being dipped, the base material to be coated with resist 10 is moved in the direction of arrow Z2 in FIG. 19 while it faces downward by the use of the XYZ directions moving means 44*b*, and it is lifted up (S 203).

Further, under the state of facing downward, the base material to be coated with resist 10 is rotated at the prescribed third speed of rotation (for example, 700 rpm) by θ direction spin-driving means 35 for the period, for example, 600 sec., and then, "regular spinning" is conducted (S 204). After that, baking (heating) processing is conducted for a period of 20 min. at the prescribed temperature of, for example, 170° C. (S205).

In the case of rotation at the prescribed speed of rotation under the condition of facing downward, a coating thickness in the shape opposite to that of the uneven portion (namely, if a shape in FIG. 7 is convex, the concave form in the case of downward rotation) is formed an area of critical point X2. Therefore, a concave shaped uneven portion is structured at least on the first layer.

Then, after making the base material to be coated with resist 10 to face upward with ψ direction spin-driving means 44*a* (S 206), θ direction spin-driving means 35 rotates spin coater chuck 20 to conduct preliminary spinning (s 207), and coating material coating means 31 makes resist L to flow down continuously for the base material to be coated with resist 10 (S 208).

In this case, control means 49 instructs so that resist may be supplied from coating material coating means 31 during a certain period of time in the preliminary spinning by coating material supply time control means 34, and gives an instruction to speed of rotation control means 36 (supplies control signals) so that θ direction spin-driving means 35 may rotate at the prescribed fourth speed of rotation (for example, 200 rpm) and further controls coating amount control means 33 and viscosity control means 32 so that an amount of coating and viscosity of the resist may be controlled. For example, in the present embodiment, when an inside diameter of a supply needle of the coating material coating means 31 is made to be 0.2 mm for resist 100 cp, the supply pressure is about 0.3 MPa for example.

Next, determination processing to check whether a period of 2 sec. has elapsed or not is conducted (S 209). When it is not determined that the period of 2 sec has elapsed, in this determination processing, the flow returns to S 208. On the other hand, when it is determined that the period of 2 sec has elapsed, in the determination processing in S 209, coating material supply time control means 34 gives an instruction to coating material coating means 31 to stop the supply of resist, thus, the supplying of resist is stopped (S 210).

Next, after raising the speed of rotation up to the fifth speed of rotation (for example, 700 rpm) that is higher than the fourth speed of rotation by the use of speed rotation control means 36 (S 211). In this regular spin, it is preferable that the speed or rotation is made to be 700 rpm and the rotation is conducted for 600 sec. Incidentally, in this case, processing S 107 and S 108 in the first processing procedures. Incidentally, in this case, S 107 and S108 in the aforementioned first processing procedure may be conducted.

Then, baking (heating) processing is conducted for the base material to be coated with resist 10 (S 212). In this case, temperature of baking is about 170° C. and period of time for baking is about 20 min.

In the aforesaid method, there is conducted preliminary spin to conduct spin-coating by returning the top portion of the base material to be coated with resist 10 to face upward again (original state), and by supplying resist solution L continuously to the rotational center to conduct spin-coating, and after that, regular spin and baking are conducted to make the second layer.

When the second layer is formed, an even portion in the vicinity of an area of the critical point X2 is supposed to be caused by the formation of the second layer. However, the shape of the uneven portion of the second layer and that of the uneven portion of the first layer are opposite each other, and these uneven portions are totally canceled. Due to this, it is possible to obtain uniform coating thickness independently of the critical point.

By employing the second processing procedure as above, the top section of the base material to be coated with a resist is arranged so as to face downward, immersed into a dip tank, and subsequently pulled up while rotated, whereby a first layer is formed. After baking, the top portion of the resultant base material coated with a resist is arranged so as to face upward and is subjected to rotation coating while continuously supplying the resist solution to the rotation center portion. By performing baking, the influence of gravity are cancelled at every coating, whereby it is possible to achieve uniform coating thickness.

As mentioned above, by employing the present embodiment, it is possible to decrease basic materials during production stage to its minimum size which is required for achieving the uniform coating thickness. By so doing, machining said base material does not take a long time. As a result, it is possible to shorten the term of works and also to enhance the throughput. Further, it is possible to cut the cost due to a decrease in the used amount of raw materials.

Further, for the portion having greater thickness due to an increase in thickness of uneven portions, the coating thickness correcting irregular portion is molded so as to form a concave, while for the portion having less thickness in the uneven portion, the coating thickness irregular portion is molded so as to form a convex. As a result, it is possible to allow the thickness of "resist coating base material and resist" to be uniform. As noted above, since it is possible to allow the first coating thickness to be uniform, it is possible to allow the thickness of the resultant coating to be approximately uniform while regulating difference in thickness of uneven portions of the second and following layers within the minimum limit (within the allowable limit).

Further, when the coating thickness correcting irregular portion is shaped so as to correct a characteristic shape, depending on said characteristic shape of an uneven portion due to characteristics of the nth layer, it is more preferable that the effects of uneven portions of each layer forming a multilayer are removed whereby finally, it is possible to assuredly achieve almost uniform coating thickness. As mentioned above, by previously molding the coating thickness correcting irregular portion for the base material to be coated with the resist, it is possible to allow the surface of the final resist layer to be uniform.

Further, by repeating the process in which the resist solution, having a viscosity of about (150 mPa·S), is subjected to rotation coating at 700 rpm so that gravity applied to the resist on a curved surface and centrifugal force are balanced, as well as the baking process, it is possible to achieve the desired thickness, resulting in being approximately uniform.

Still further, by continuously supplying said resist solution into the press pin with respect to the rotation center shaft of the base material to be coated with the resist, it is possible to compensate a decrease in said resist solution at the rotation center portion due to rotation. As a result, a monotonous increase in the coating thickness distribution from the rotation center portion to the peripheral portion does not occur.

Still further, during rotation, force acting downward is applied to a resist solution on the curved surface portion. As a result, by allowing downward movement employing the gravity control means only for the period of rotation, force acting upward, which cancels said force acting downward is generated, whereby it is possible to remove the influence of gravity, which is applied to said resist solution during rotation. In particular, when downward action is only performed during a period of time when resist solution L flows on the slope of curved surface portion 12, its effect is more pronounced. Accordingly, by performing downward movement in the vertical direction during rotation, it is possible to decrease the influence of gravity applied to the resist solution on said curved surface portion, whereby it is possible to allow the coating thickness distribution of said resist layer to become more uniform.

Further, the top portion of the base material to be coated with a resist is arranged to face downward, dipped in a dip tank, and subsequently pulled up while rotated, whereby a first layer is formed. After baking, the top portion of the resultant base material to be coated with the resist is arranged to face upward and is subjected to rotary coating while continuously supplying the resist solution onto the rotation center portion, followed by baking. By so doing, it is possible to result in uniform coating thickness by canceling the influence of gravity at each coating.

Further, it is possible to remove surface roughness such as tool marks and others. As a result, the coating thickness is determined without resulting in any problems even though it is optically evaluated. Still further, it is possible to carry out the feedback of all the measurement results to investigate the resist coating method.

Further, centrifugal force, generated during spin coating, is uniformly applied to the resist on the curved surface portion, resulting in no hindrance against the spread of the resist to its periphery. As a result, it is possible to obtain a uniform coating thickness distribution on said curved surface portion. A non-uniform coating thickness portion due to stress, which is generated by the separation of the drop of said resist solution from the base material, is only formed in the peripheral curved surface portion.

Further, by forming concave portions or convex portions as a position recognizing section of the peripheral plane portion of the base material to be coated with the resist, said resist is not allowed to spread onto said position recognizing section. As a result, the recognition accuracy of said position recognizing section in the exposure apparatus of the subsequent process is enhanced.

Further, since the rotation center of said base material to be coated with the resist, having a curved surface, is arranged so as to coincide with the rotation center of the spin coater chuck, centrifugal force generated during spin coating is uniformly applied to said resist, whereby it is possible to obtain the uniform coating thickness distribution on said curve surface portion.

(Second Embodiment)

Figure 21:
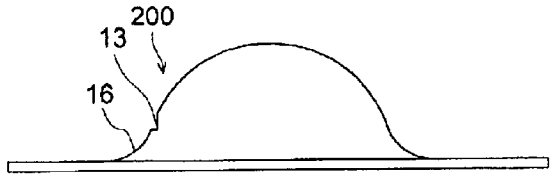
Figure 21:
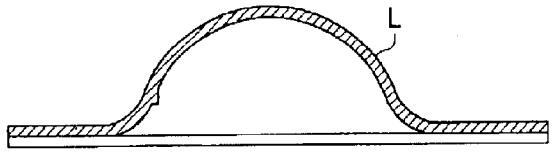
Figure 21:
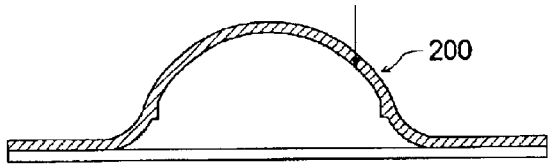
Figure 21:
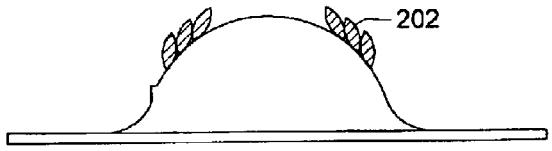
Figure 21:
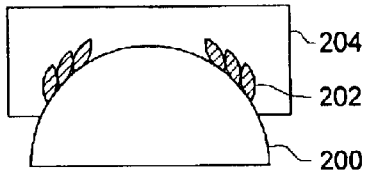
Figure 21:
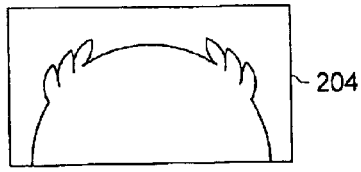

The second embodiment according to the present invention will now be described with reference to FIG. 21. Incidentally, description is abbreviated with regard to the substantially same constitution as the aforesaid first embodiment, and different portions will be described.

In the aforesaid first embodiment, the resist coating process is disclosed. In the present example, described is a total process including the aforesaid process, especially, a process for producing molding dies and others, which are employed to produce optical lenses such as optical elements and others by molding.

First, a molding die (non-electrolysis nickel and others) is subjected to an aspheric treatment through machining, utilizing an ultra-high precision lathe (a machining process). Subsequently, as shown in FIG. 21(A), the aforesaid base material 200, having an aspheric surface, is produced through resin molding, employing said molding die (a resin molding process). Further, the resultant base material 200 is washed and subsequently dried.

Thereafter, resinous base material 200 is subjected to a surface treatment (a resin surface treatment process). During said process, for example, a process, such as Au vacuum deposition and others, may be performed. Specifically, as shown in FIG. 21(B), base material 200 is positioned as specified and is then subjected to spin coating, which is the same as the aforesaid first embodiment, in such a manner that resist L is continuously allowed to flow downward while rotating the spinner. Further, pre-baking and others are carried out.

After said spin coating, the coating thickness of said resist layer is determined and evaluated (a resist layer evaluation process). Further, as shown in FIG. 21(C), base material 200 is positioned as specified. Subsequently, said base material 200 is subjected to image drawing, employing light or electron beam exposure, while controlling it at each of the X, Y, and Z axes.

Subsequently, resist layer L on said base material 200 is subjected to a surface smoothing process (a surface smoothing process). Further, as shown in FIG. 21(D), while positioning said base material 200 as specified, development is carried out (a development process). Still further, a surface hardening process is carried out.

Subsequently, depending on SEM observation or utilizing a coating thickness meter, the shape of the resultant resist is evaluated (a resist shape evaluation process).

Thereafter, an etching process, employing dry etching and others, is carried out.

Incidentally, after said resist coating, the peripheral plane portion as well as the peripheral curved surface portion is subjected to a cutting process during any of these processes.

Subsequently, in order to prepare molding die 204 for surface-processed base material 200, as shown FIG. 21(E), a molding die pre-electroforming process is carried out. Thereafter, an electroforming process and others are performed. Further, as shown in FIG. 21(F), a process is carried out in which said base material 200 is separated from said molding die 204.

The resultant surface-processed base material, as well as the resultant separated molding die 204, is subjected to a surface treatment (a molding die surface treatment process). Subsequently, the resultant molding die 204 is evaluated. After evaluation, molds are prepared employing said molding die 204. Thereafter, said molds are evaluated.

As mentioned above, by utilizing the present embodiment, it is possible to easily produce a molding die to carry out injection molding of the aforesaid optical elements.

Although the apparatus and methods according to the present invention have been described based on some of specified embodiments thereof, it is understood that various changes and modifications of said embodiments may be made in the present invention without departing from the spirits and scope thereof. For example, in each of the aforesaid embodiments, the peripheral plane portion is molded to be a plane, but a taper may be molded which declines downward while directing to the peripheral exterior. Alternatively, a slightly distorted curved surface or a structure, which partially has a curved surface and an angle portion, may be allowed in such a manner that no problems occur for allowing the coating thickness of the curved portion to be uniform.

In addition, each radius of curvature, having a radius of R1 or R2, may be optimally determined as long as the aforesaid conditions are satisfied.

Further, with regard to the regular spin, the case, in which gravity control is performed, has been described. However, alternatively, said gravity control may be carried out employing the pre-spin. In such a case, the coating proceeds as follows. In the rotary coating process, the aforesaid coating material is allowed to continuously flow from the top portion of the aforesaid curved portion of the base material to be coated. The aforesaid coating material, which has been allowed to flow down onto the aforesaid top portion at the specified speed of rotation, is allowed to smoothly flow from the aforesaid top portion to the peripheral surface portion of the aforesaid curved surface portion while maintaining approximately uniform layer thickness, and the aforesaid base material to be coated is moved toward the rotation axis direction opposite the coating thickness forming surface at the specified acceleration. During this operation, it is preferable that the movement at the aforesaid acceleration is carried out within the period of time when the aforesaid coating material completely cover the curved surface portion of the aforesaid base material to be coated.

Further, after forming the first layer, even in the second processing procedure, each layer may be formed employing any of the coating methods of the first or second processing procedures. In such a case, it is optional to apply a gravity control. For example, the aforesaid top portion of the aforesaid base material to be coated, having thereon the first layer of the aforesaid coating material, is arranged to face upward. Thereafter, in the rotary coating process, the aforesaid coating material is allowed to flow down on the aforesaid first layer from the aforesaid top portion of the aforesaid curved surface portion. Thus, while the aforesaid base material to be coated is rotated at the first rotation speed, the aforesaid coating material, which has been allowed to flow down onto the aforesaid top portion, is allowed to flow down on the aforesaid first layer from the aforesaid top portion to the peripheral surface portion of the aforesaid curved surface portion, while maintaining an approximately uniform coating thickness, whereby a second layer is coated.

Incidentally, by terminating the continuous supply of the coating material, the aforesaid base material to be coated may be moved to the rotation axis direction on the opposite side against the coating layer surface, under rotation at a higher speed than that of the first rotation.

On the other hand, the following may be carried out. After arranging the aforesaid top portion of the aforesaid base material to be coated, which has thereon the first layer of aforesaid coating material, so as to face upward, the aforesaid coating material is allowed to continuously flow on the aforesaid first layer from the aforesaid top portion of the curved surface portion. Subsequently, while the aforesaid base material to be coated is rotated at the first rotation speed, the aforesaid coating material, which has been allowed to flow down onto the aforesaid top portion, is allowed to flow down on the aforesaid first layer from the aforesaid top portion to the peripheral surface portion of the aforesaid curved surface portion, while maintaining an approximately uniform coating thickness, whereby a second layer is coated. During said coating, the aforesaid base material to be coated may be moved to the rotation axis direction on the opposite side against the coating layer surface, under rotation at a higher speed than that of the first rotation.

Further, the aforesaid embodiment includes various stages. Therefore, it is possible to derive various inventions from appropriate combinations of a plurality of disclosed constitution elements. Namely, needless to say, the present invention include examples derived from the combinations of each of embodiments, as well as combinations of any of aforesaid embodiments with modifications thereof. Further, the present invention includes the constitutions in which some of constitution elements are removed from the total constitution elements described in the aforesaid embodiments.

EFFECTS OF THE INVENTION

As mentioned above, according to the present invention, it is possible to compensate a decrease in the coating material at the rotation center portion due to rotation by continuously supplying said coating material to the rotation center of the base material to be coated during the rotation of a rotary coating process, whereby the resultant coating layer thickness distribution from said rotation center portion on the curved surface portion of the aforesaid base material to be coated to the boundary region of the peripheral surface portion does not results in a monotonous increase.

Further, during rotation of the rotary process, force acting downward is applied to the coating material on the curved surface portion. As a result, by performing downward movement, employing the gravity control means only for a period of time of rotating, force acting upward, which cancels the aforesaid force acting downward, is generated. As a result, it is possible to remove the influence of gravity which is applied to the coating material during rotation. Specifically, only for a period of time when the coating material covers the entire slope surface of the curved surface portion, by carrying out operation facing downward, the resultant effects are pronounced. Accordingly, by performing movement facing downward during rotation, it is possible to decrease the influence of gravity applied to the coating material on the curved surface portion. As a result, it is possible to allow the coating material to result in the uniform coating thickness distribution.

In addition, the top portion of the base material to be coated is arranged to face downward, dipped into a solution tank, and pulled up while rotated, whereby the first layer is formed. After heating the resultant coating, the top portion of said base martial to be coated is arranged to face upward, and is subjected to rotary coating while continuously supplying the coating material to the rotation center portion. Subsequently the resultant coating is heated. By so doing, at every coating, it is possible to achieve uniform coating thickness while canceling the influence of gravity.

Further, molding is carried out so that the distance between the rotation center of the aforesaid curved surface portion and the peripheral edge of the aforesaid peripheral portion is by a factor of less than or equal to about 4 of the radius of the aforesaid curved surface portion. Thus, by allowing the size of the aforesaid base material to be coated to be the minimum limit, it is possible to decrease the main material size. Due to that, machining said base material does not take a longtime. As a result, it is possible to shorten the term of works and also to enhance the throughput. Further, it is possible to cut cost due to a decrease in the used amount of raw materials.

Still further, for the portion having greater thickness due to an increase in thickness of uneven portions formed in the boundary region between the curved surface porting and the peripheral surface portion, the coating thickness correcting irregular portion is molded so as to form a concave, while for the portion having less thickness in the uneven portion, the coating thickness irregular portion is molded so as to form a convex. As a result, it is possible to allow the thickness of "the base material to be coated and the coating material" to be uniform. As noted above, since it is possible to make the first coating thickness uniform, it is possible to make the thickness of the resultant coating approximately uniform while regulating difference in thickness of uneven portions of the second and following layers within the minimum limit (within the allowable limit).

Further, when the coating thickness correcting irregular portion is shaped so as to correct a characteristic shape, depending on said characteristic shape of an uneven portion due to characteristics of the uppermost layer of a plurality of layers, it is more preferable that the effects of uneven portions of each layer forming a multilayer are removed whereby finally, it is possible to assuredly obtain almost uniform coating thickness. As mentioned above, by previously molding said coating thickness correcting irregular portion for the base material to be coated, it is possible to allow the surface of a final resist layer to be uniform.

Further, by adjusting the speed of rotation of the rotary coating process to the range of 200 to 700 (rpm), it is possible to appropriately apply the coating material having a viscosity of less than or equal to about 150 (mPa·S) onto the total curved surface portion of the base material to be coated before beginning of its drying.

Still further, by adjusting the speed of rotation of the rotary process to about 700 (rpm), gravity and centrifugal force, which are applied to the coating material on the curved surface portion, are balanced, whereby it is possible to uniformly apply the coating material having a viscosity of about 150 (mPa·S) onto said base material to be coated. In addition, by repeating the aforesaid rotary process as well as the aforesaid baking process, it is possible to result in the desired thickness which is almost uniform.

Still further, elements are machined employing an ultra-high precision lathe so as to result in the specified surface roughness, followed by polishing, whereby it is possible to remove surface roughness such as tool marks and others. As a result the coating thickness is determined without any problems even though it is optically evaluated. In addition, it is possible to carry out the feedback of all the measurement results to investigate the coating of coating materials.

What is claimed is:

1. A method of coating a coating liquid on a base material having a curved surface portion, comprising:

making a predetermined shape of the base material wherein a peripheral surface portion of the base material is shaped to comprise a peripheral flat portion formed around the curved surface portion and a peripheral curved surface portion formed on a boundary region between the curved surface portion and the peripheral flat portion so as to flow the coating liquid smoothly, continuously pouring down the coating liquid onto an apex portion of the curved surface portion, coating the poured-down coating liquid from the apex portion of the curved surface portion toward a peripheral surface portion of the curved surface portion by rotating the base material at a first rotating speed during continuously pouring down the coating liquid, stopping pouring down the coating liquid, rotating the base material coated with the coating liquid at a second rotating speed greater than the first rotating speed.

2. The method of claim 1, wherein a layer thickness correcting concave/convex portion is formed on the boundary region.

3. The method of claim 2, wherein the layer thickness correcting concave/convex portion is formed based on standard data predetermined for the layer thickness correcting concave/convex portion.

4. The method of claim 3, wherein the standard data for the layer thickness correcting concave/convex portion are obtained by measuring a layer thickness of the coating material at each radial position in a plurality of base materials coated with the coating liquid and by calculating deviations from a standard layer thickness and calculating an average of the deviations in the plurality of base materials.

5. The method of claim 1, wherein the curved surface portion includes an effective curved surface portion provided from the center of the apex portion adhered with the poured-down coating liquid to a predetermined effective radius on which a coated layer thickness distribution is necessary to be almost uniform, the first radius of curvature on the curved surface portion is one to ten times of the second radius of curvature on the peripheral curved surface portion, and a boundary region between the peripheral flat surface portion on which the inclination of a tangent line to the peripheral curved surface becomes almost zero and the peripheral curved surface portion is formed at a position distant from the center of the apex portion by at least twice of the effective radius of the effective curved surface portion.

6. The method of claim 5, wherein a distance from the center of rotation of the curved surface portion to a peripheral end of the peripheral surface portion is formed to be smaller than four times of the radius of the curved surface portion.

7. The method of claim 1, wherein making the predetermined shape of the base material is by cutting the base material.

8. The method of claim 7, wherein a surface roughness of the curved surface portion is made 50 nm or less by cutting.

9. The method of claim 7, further comprising:

polishing the curved surface portion after making the predetermined shape of the base material.

10. The method of claim 1, wherein the base material is made of a resin.

11. The method of claim 1, wherein the base material is made of an n-type silicone.

12. The method of claim 1, further comprising: hardening the base material coated with the coating liquid after rotating.

13. The method of claim 1, further comprising; baking the base material coated with the coating liquid at a predetermined baking temperature after rotating.

14. The method of claim 13, wherein the predetermined baking temperature is 100° C. to 200° C.

15. The method of claim 2, wherein the viscosity of the coating liquid is 150 (mPa·S) or less.

16. The method of claim 15, wherein the temperature of the coating liquid during coating is 22° C. to 24° C.

17. The method of claim 16, wherein the second rotating speed is about 700 rpm.

18. A method of coating a coating liquid on a base material having a curved surface portion, comprising:

continuously pouring down the coating liquid onto an apex portion of the curved surface portion, coating the poured-down coating liquid from the apex portion of the curved surface portion toward a peripheral surface portion of the curved surface portion by rotating the base material at a first rotating speed during continuously pouring down the coating liquid, stopping pouring down the coating liquid, rotating the base material coated with the coating liquid at a second rotating speed greater than the first rotating speed, wherein the base material comprises a peripheral flat portion formed around the curved surface portion and a peripheral curved surface portion formed on a boundary region between the curved surface portion and the peripheral flat portion in the peripheral surface portion so as to flow the coating liquid smoothly.

19. The method of claim 18, wherein the base material comprises a layer thickness correcting concave/convex portion formed on the boundary region.

20. The method of claim 18, wherein the curved surface portion includes an effective curved surface portion provided from the center of the apex portion adhered with the poured-down coating liquid to a predetermined effective radius on which a coated layer thickness distribution is necessary to be almost uniform, the first radius of curvature on the curved surface portion is one to ten times of the second radius of curvature on the peripheral curved surface portion, and a boundary region between the peripheral flat surface portion on which the inclination of a tangent line to the peripheral curved surface becomes almost zero and the peripheral curved surface portion is formed at a position distant from the center of the apex portion by at least twice of the effective radius of the effective curved surface portion.

21. The method of claim 20, wherein a distance from the center of rotation of the curved surface portion to a peripheral end of the peripheral surface portion is formed to be smaller than four times of the radius of the curved surface portion.

22. The method of claim 18, further comprising: hardening the base material coated with the coating liquid after rotating.

23. The method of claim 18, further comprising: baking the base material coated with the coating liquid at a predetermined baking temperature after rotating.

24. The method of claim 23, wherein the predetermined baking temperature in the baking process is 100° C. to 200° C.

25. The method of claim 19, wherein the viscosity of the coating liquid is 160 (mPa·S) or less.

26. The method of claim 25, wherein the temperature of the coating liquid during Coating is 22° C. to 24° C.

27. The method of claim 26, wherein the second rotating speed is about 700 rpm.

* * * * *